US008657474B2

(12) United States Patent
Breen, IV et al.

(10) Patent No.: US 8,657,474 B2
(45) Date of Patent: Feb. 25, 2014

(54) ELECTRICAL SOCKET, APPARATUS AND SYSTEM

(75) Inventors: Dennis M. Breen, IV, West Chicago, IL (US); Benjamin D. Swedberg, Sycamore, IL (US); Alan E. Zantout, Sycamore, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 475 days.

(21) Appl. No.: 12/983,660

(22) Filed: Jan. 3, 2011

(65) Prior Publication Data

US 2011/0164424 A1 Jul. 7, 2011

Related U.S. Application Data

(60) Provisional application No. 61/292,289, filed on Jan. 5, 2010.

(51) Int. Cl.
*F21V 15/01* (2006.01)
*F21V 29/00* (2006.01)
*F21V 7/00* (2006.01)

(52) U.S. Cl.
USPC ..... 362/368; 362/365

(58) Field of Classification Search
None
See application file for complete search history.

(56) References Cited

U.S. PATENT DOCUMENTS 3,093,433 A 6/1963 Ege
3,351,884 A 11/1967 Pistey
3,488,626 A 1/1970 Koerper, at al.
3,935,445 A 1/1976 Preisler
4,040,709 A 8/1977 Dola et al.
4,133,595 A 1/1979 Pritulsky
4,704,664 A 11/1987 McNair
4,764,128 A 8/1988 Cheng
4,922,393 A 5/1990 McNair
4,962,447 A 10/1990 Ullman
4,971,567 A 11/1990 Mizuno
5,057,979 A 10/1991 Carson et al.
5,494,456 A 2/1996 Kozel et al.
5,662,414 A 9/1997 Jennings et al.
5,738,436 A 4/1998 Cummings et al.
5,746,507 A 5/1998 Lee
5,927,843 A 7/1999 Haugaard et al.
5,997,158 A 12/1999 Fischer et al.
6,030,102 A 2/2000 Gromotka
6,039,597 A 3/2000 Getselis et al.
6,059,422 A 5/2000 Fischer et al.
6,082,878 A 7/2000 Doubek et al.
6,116,749 A 9/2000 Quiogue et al.
6,123,438 A * 9/2000 Hentz ..... 362/373
6,149,280 A 11/2000 Quiogue et al.
6,168,299 B1 1/2001 Yan
6,264,344 B1 7/2001 Quiogue et al.
6,290,522 B1 9/2001 Campolo et al.
6,299,327 B1 10/2001 Camarota
(Continued)

*Primary Examiner* — Ashok Patel
(74) *Attorney, Agent, or Firm* — Cook Alex Ltd.

(57) ABSTRACT

A socket assembly, electrical apparatus and system are disclosed. The socket assembly may incorporate wire push-in terminations or accept wire plug terminations. The socket assembly may be joined to or integrally formed with the electrical apparatus. A plurality of the apparatus incorporating the socket assemblies may be combined into a system. Particular embodiments illustrating various configurations of the socket assemblies, light fixtures including such socket assemblies and a lighting system including a plurality of such light fixtures are disclosed. The socket assemblies also may incorporate terminal assemblies that include two or more metal components to permit daisy chaining of a plurality of the electrical apparatus.

16 Claims, 27 Drawing Sheets

(56) References Cited

U.S. PATENT DOCUMENTS

| | | | | |
|---|---|---|---|---|
| 6,367,945 | B2 | 4/2002 | Quiogue et al. | |
| 6,375,338 | B1 | 4/2002 | Cummings et al. | |
| 6,570,306 | B2 | 5/2003 | Henrici et al. | |
| 6,588,922 | B1 | 7/2003 | DeCicco | |
| 6,682,364 | B2 | 1/2004 | Cisey | |
| D500,736 | S | 1/2005 | Isoda et al. | |
| 6,964,504 | B2 | 11/2005 | Newbold | |
| 6,972,570 | B2 | 12/2005 | Schriefer | |
| 7,168,825 | B2 | 1/2007 | McArthur | |
| 7,192,315 | B2 | 3/2007 | Powers et al. | |
| 7,249,867 | B2 * | 7/2007 | Hagen et al. | 362/267 |
| 7,394,019 | B2 | 7/2008 | Gesue | |
| 7,399,105 | B2 | 7/2008 | Southard et al. | |
| 7,436,675 | B2 | 10/2008 | Rimmer et al. | |
| 7,465,174 | B1 | 12/2008 | Haggis et al. | |
| 7,467,888 | B2 | 12/2008 | Fiene | |
| 7,524,078 | B1 * | 4/2009 | Pressel et al. | 362/153 |
| 7,530,705 | B2 | 5/2009 | Czech et al. | |
| 7,575,338 | B1 | 8/2009 | Verfuerth | |
| 7,806,550 | B2 * | 10/2010 | Tyson et al. | 362/153 |
| 2004/0145899 | A1 * | 7/2004 | Riebling et al. | 362/487 |
| 2004/0232775 | A1 | 11/2004 | Nilssen | |
| 2008/0165538 | A1 | 7/2008 | Callahan | |
| 2008/0227318 | A1 | 9/2008 | Classen et al. | |
| 2009/0017660 | A1 | 1/2009 | Braganza et al. | |
| 2009/0029596 | A1 | 1/2009 | Owen, Sr. et al. | |
| 2009/0039799 | A1 * | 2/2009 | Newman et al. | 315/291 |
| 2009/0053925 | A1 | 2/2009 | Pyrros | |
| 2009/0120683 | A1 | 5/2009 | Hybiske et al. | |
| 2009/0130879 | A1 | 5/2009 | Johnson et al. | |
| 2009/0141499 | A1 | 6/2009 | Fabbri et al. | |
| 2009/0147507 | A1 | 6/2009 | Verfuerth et al. | |
| 2009/0181565 | A1 | 7/2009 | Rubin et al. | |
| 2009/0185378 | A1 * | 7/2009 | Pressel et al. | 362/277 |
| 2009/0186517 | A1 | 7/2009 | Keswani et al. | |
| 2009/0227132 | A1 | 9/2009 | Bethurum et al. | |
| 2009/0231862 | A1 * | 9/2009 | Seo | 362/365 |
| 2010/0014282 | A1 * | 1/2010 | Danesh | 362/147 |

* cited by examiner

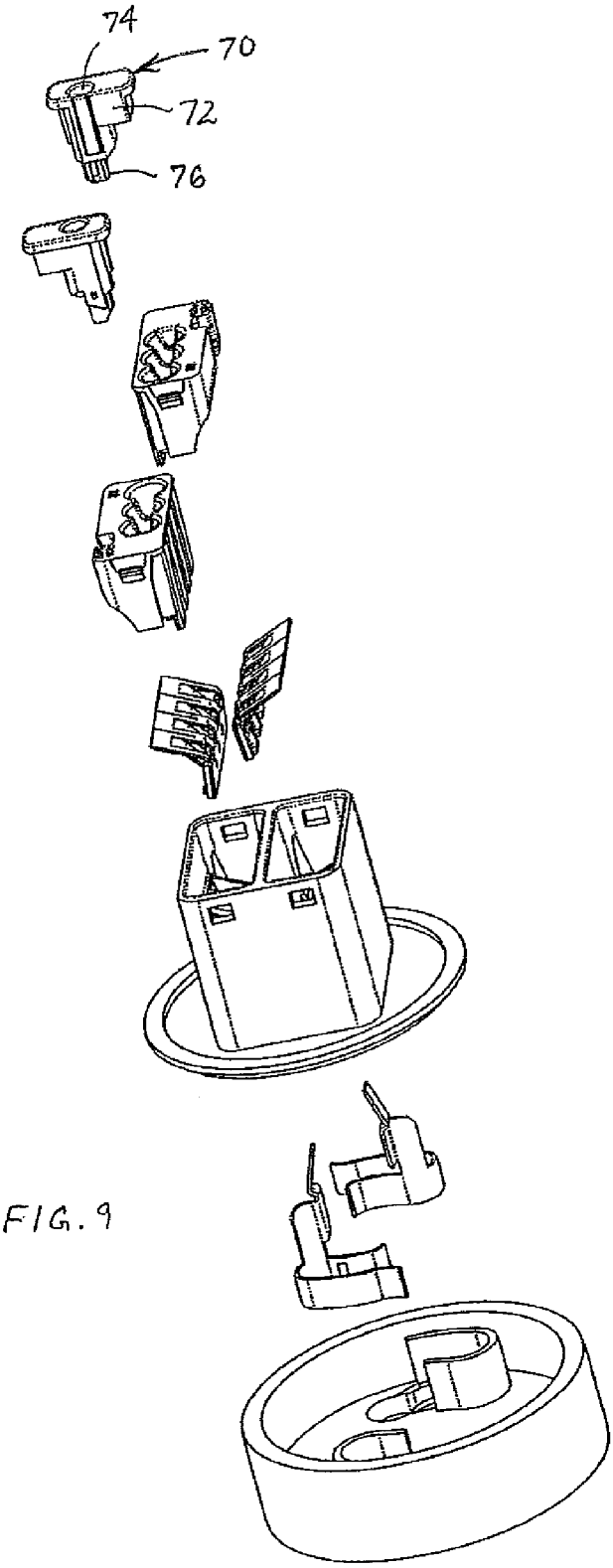
FIG. 9
FIG. 8
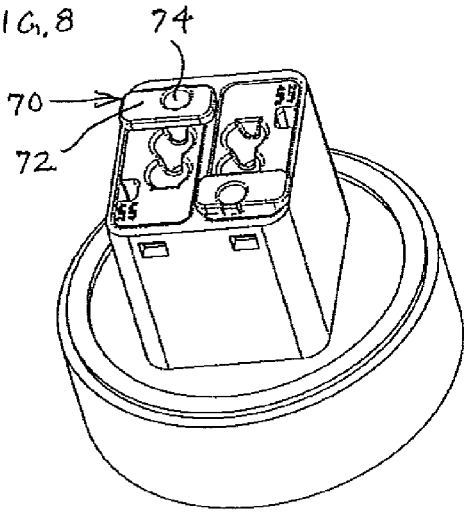

ELECTRICAL SOCKET, APPARATUS AND SYSTEM

CROSS-REFERENCE TO RELATED APPLICATION

This application claims the benefit of U.S. Provisional Patent Application Ser. No. 61/292,289, filed Jan. 5, 2010, the disclosure of which is hereby incorporated by reference in its entirety.

BACKGROUND

This disclosure relates generally to novel electrical socket assemblies for use in electrical apparatus and in systems incorporating such electrical apparatus. A possible, but by no means exclusive, application for the example socket assemblies is in the form of integrated light fixtures for commercial or residential down lighting, otherwise known as recessed light fixtures, often also referred to as "cans" for recessed lighting. A plurality of such light fixtures or cans may be electrically connected together to form a lighting system. Such light fixtures historically have used relatively inefficient light sources such as incandescent bulbs and, to a lesser extent, compact fluorescent (CFL) bulbs. These light sources tend to produce sufficient heat to require temperature sensitive components, such as ballasts, to be contained within a separate junction box that is spaced apart from the lamp housing, often several inches away. For the same reason, all electrical connections to the building wiring are made in non-adjacent junction boxes, leading to inconvenient access for installation and repairs.

SUMMARY

Examples of electrical socket assemblies are disclosed and shown in combination with examples of alternative light fixtures that are adapted to utilize the socket assemblies. To further illustrate use of such socket assemblies and apparatus in a system, lighting systems having a plurality of such light fixtures also are disclosed. Indeed, some examples show light fixtures having an integrated lighting assembly with a single piece housing construction, but it will be understood that alternative socket assembly structures, lamp housings, junction boxes, branch circuit wiring connectors and corresponding additional hardware may be utilized. Importantly, the advantageous combinations of components provide a reduction of cost and size of electrical assemblies, as well as more convenient and faster field installation. While shown in examples involving light fixtures and lighting systems, it will be appreciated that the socket assemblies could be incorporated into other electrical apparatus and systems.

The example socket assemblies and light fixtures disclosed herein are adapted for use with lighting sources, such as new LED bulbs, which use less energy and generally produce less heat. The example integrated socket assemblies and light fixtures are simpler to manufacture and install, as well as reduce the material usage and cost associated with producing electrical apparatus, such as lighting products. It will be appreciated that while the examples illustrated herein include a socket with two apertures and contacts for a two pin lamp base, alternative bulb or lamp connectors may be utilized, such as configurations to receive screw-in, four pin or other lamp or bulb bases.

The example socket assemblies and light fixtures remove the more costly and cumbersome separate junction boxes and allow electrical connections to building wiring to be made adjacent to the lamp housing, and even to be included in the socket for the lamp. The disclosed socket assemblies are configured to allow for the ability to daisy chain a plurality of light fixtures, by connecting from one socket to one or more additional sockets of corresponding light fixtures. Thus, once the building wiring connection points are attached to the socket assembly, the socket assembly may be included within a lighting system that includes a plurality of light fixtures, such as for use in residential or commercial construction when it is desired to install multiple lights in a ceiling.

With respect to the electrical capacity of the socket assemblies, it is important to note that electrical codes normally require that a daisy chaining connection must be able to safely carry a full branch circuit current load which, in the U.S., commonly is 20 amps. In examples that incorporate push-in wire connections, each separate pole of the disclosed socket assemblies preferably includes at least two metal pieces, one that generally conducts the electricity, and one that generally provides contact pressure to the wire (although either could perform both functions and the one that conducts the electricity also may integrally include the contacts for the lamp base). Accordingly, it is preferred that the socket assemblies of an electrical apparatus, such as a light fixture, include both input and output wire connection ports utilizing two or more pieces of metal in the electrical contacts, which may be configured to be joined in a terminal assembly having a spring and a shorting member in the form of a busbar.

Additionally, these wire connection points could be configured for push-in, zero insertion force, or individual wires or wires in a wiring harness may be utilized with a plug termination of each wire. The wires may be connected to the contacts within such plugs by common connecting structures and methods, such as are employed with crimped wire contacts and the like. The disclosure also includes the potential use of a Ground termination along side the Hot and Neutral terminations so that a cable, such as non-metal sheathed cable can be terminated directly and completely at the socket assembly.

As illustrated in the present disclosure, the ability to integrate the socket assembly into an electrical apparatus, such as a light fixture, further presents an opportunity to utilize a light fixture that integrates a junction box or removes the junction box entirely. Thus, a junction box may be incorporated directly into the lamp housing to form a single unit. This eliminates the structure and components that are required for supporting and locating a remote junction box. From a manufacturing cost perspective, the disclosed socket assemblies permit a junction box and lamp housing generally to be made of a single material or via a single step process to form an integrated unit. For instance, the lamp housing may be made with an integral junction box in the form of a single piece unit, such as by injection molding thermoplastic or other polymers. Such unit may accept one or more doors or covers to provide isolation and desired access.

For instance, the light fixture apparatus disclosed permits access to the connections within a junction box via a cover assembly in the form of an interior door within the lamp housing or via a junction box cover. Such a separate cover assembly in the form of an access interior door could be made of a similar or different material than the lamp housing and could be located on any side wall, including the top, of the lamp housing. Similarly, with respect to a separate exterior junction box cover, the cover could be made of a similar or different material than the junction box and could be located on any side wall, including the top of the junction box. The socket assembly also could be made to have a skirt or flange that projects outward and collectively acts as an interior door or a junction box cover.

The present disclosure additionally illustrates that the number of components required can be reduced further if the lamp housing, socket assembly, and junction box are all made as a single piece light fixture with the cover for the connectors and junction box being additional components. However, covers also could be formed with the integrated units by utilizing living hinge structures.

The disclosed socket assemblies and electrical apparatus will support use of new light sources in a variety of applications. Some may, like the above-mentioned examples, utilize AC power directly or AC converted to DC power. Others may benefit from DC power distributed through a building. Distributed DC systems could be installed without many of the electrical code requirements of AC premise wiring, and thus may not need a junction box at the lighting fixture. The disclosure includes a light fixture that includes a lamp housing having a body for the socket assembly and being primarily of single piece construction.

Thus, it will be appreciated that the present disclosure provides examples of various forms of socket assemblies, electrical apparatus that may incorporate such socket assemblies and systems which may utilize a plurality of such socket assemblies and/or electrical apparatus. Accordingly, while the present disclosure shows and demonstrates various example components, the examples are merely illustrative and are not to be considered limiting. It will be apparent to those of ordinary skill in the art that various socket assemblies, electrical apparatus and systems can be constructed without departing from the scope or spirit of the present disclosure. Thus, although certain examples have been described herein, the scope of coverage of this patent is not limited thereto.

BRIEF DESCRIPTION OF THE DRAWINGS

In describing the preferred examples, reference is made to the accompanying drawing figures wherein like parts have like reference numerals, and wherein:

FIG. 8 is a top perspective view of an alternative example of the socket assembly shown in FIG. 1, but including a pair of zero insertion force receptors.

FIG. 9 is a perspective exploded view of the socket assembly shown in FIG. 8.

Figure 1:
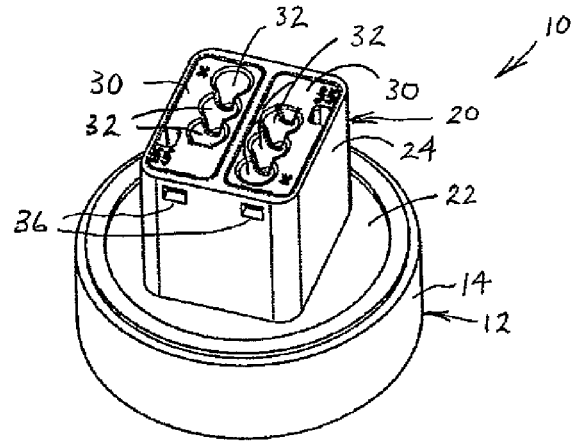
FIG. 1 is a top perspective view of a first example of a socket assembly, with the socket assembly including a push-in connector to receive the conductors of wires that are terminated in stripped ends.
Figure 2:
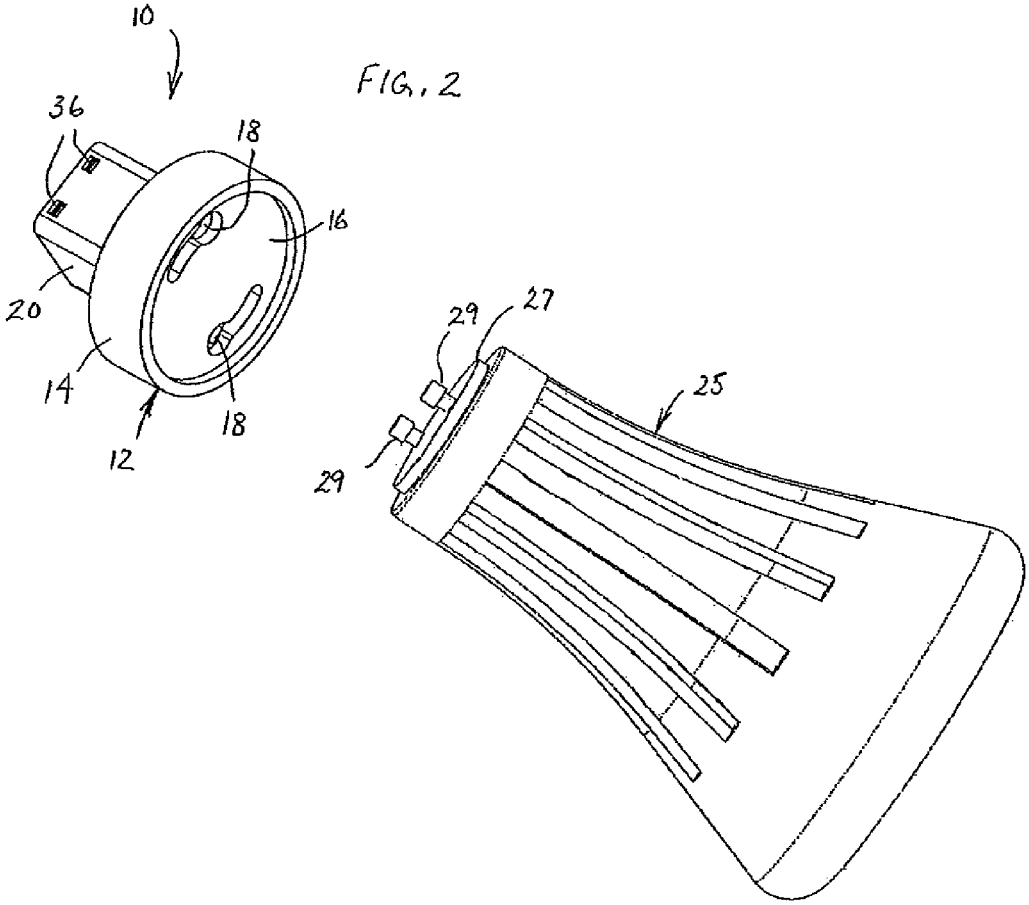
FIG. 2 is a perspective exploded view showing the bottom of the socket assembly shown in FIG. 1 and a corresponding lamp having a lamp base configured to be received by the socket assembly.
Figure 3:
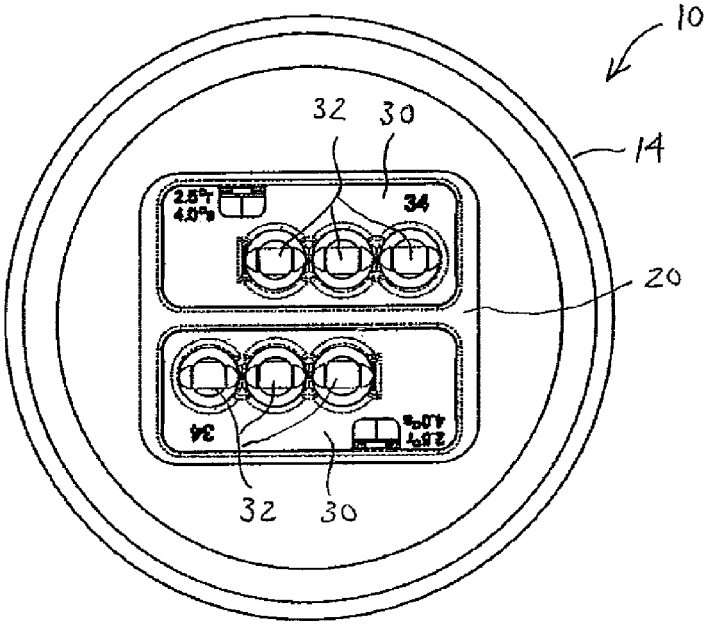
FIG. 3 is a top plan view of the socket assembly shown in FIG. 1.
Figure 4:
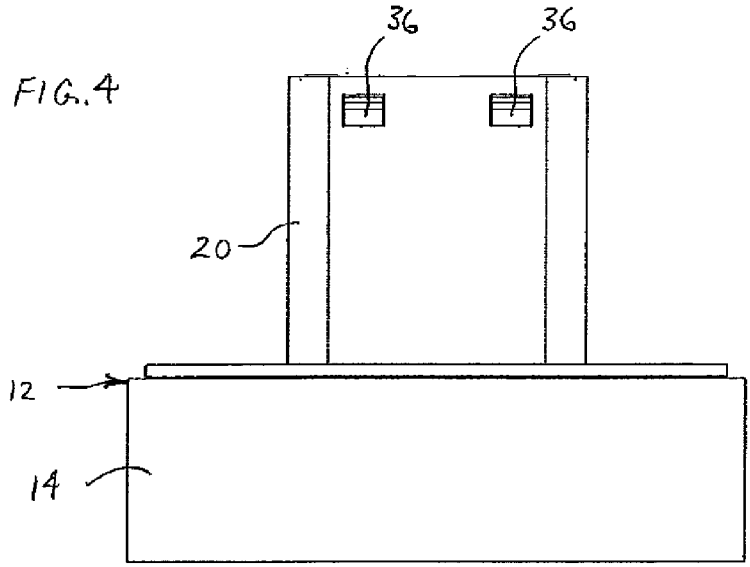
FIG. 4 is a side elevation view of the socket assembly shown in FIG. 1.
Figure 5:
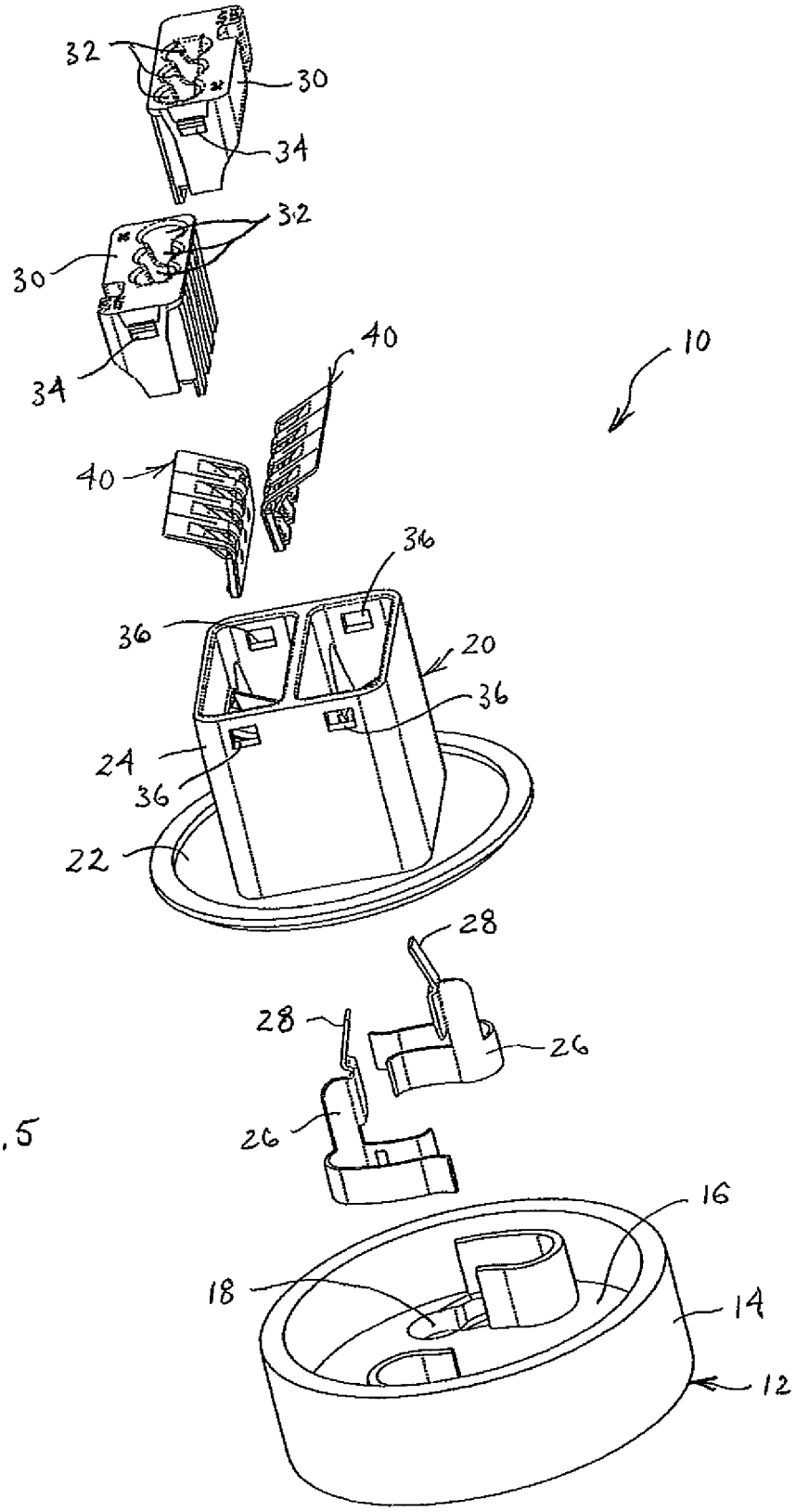
FIG. 5 is a perspective exploded view of the socket assembly shown in FIG. 1.

It should be understood that the drawings are not to scale. While some details regarding fastening means and other plan and section views of the particular components, have been omitted, such details are considered within the comprehension of those skilled in the art in view of the present disclosure. It also should be understood that the present disclosure is not limited to the examples illustrated.

DETAILED DESCRIPTION OF THE PREFERRED EMBODIMENTS

FIGS. 1-7 illustrate a socket assembly adapted for connection to an electrical apparatus, where the socket assembly includes multiple terminal assemblies with each terminal assembly having two or more metal components. The terminal assemblies are adapted for engagement by a lamp base and are adapted to receive push-in terminations. For instance, the example socket assembly 10 has a base 12 with a side wall 14 and a bottom wall 16. The bottom wall 16 includes a pair of arcuate, key-hole shaped apertures 18. Joined to the base 12 is a connector housing 20 having a cover portion 22 and an upstanding side wall 24. Enclosed between the bottom wall 16 of the base 12 and the connector housing 20 are contacts 26 for connection to a lamp 25 having a lamp base 27 and conductors configured as posts or pins 29 of the lamp base. It will be appreciated that the apertures and contacts of the socket assembly that are provided to engage a lamp base could be of an alternative configuration, such as a screw-in, four pin or other configuration, as desired to accommodate a selected lamp or bulb base.

The socket assembly 10 includes housing connector caps 30 having wire entry ports 32 for push-in wire termination to a power source, as well as to one or more additional socket assemblies (not shown). The housing connector caps 30 are adapted to permit entry of Hot wires through one of the caps and Neutral wires through the other of the caps. As discussed further herein, there can be configurations that include a third connector cap for receiving Ground wires. In this illustrated example, the housing connector caps 30 also include locking tabs 34 which engage mounting apertures 36 in the side wall of the connector housing 20 when the housing connector caps 30 are installed.

Figure 6:
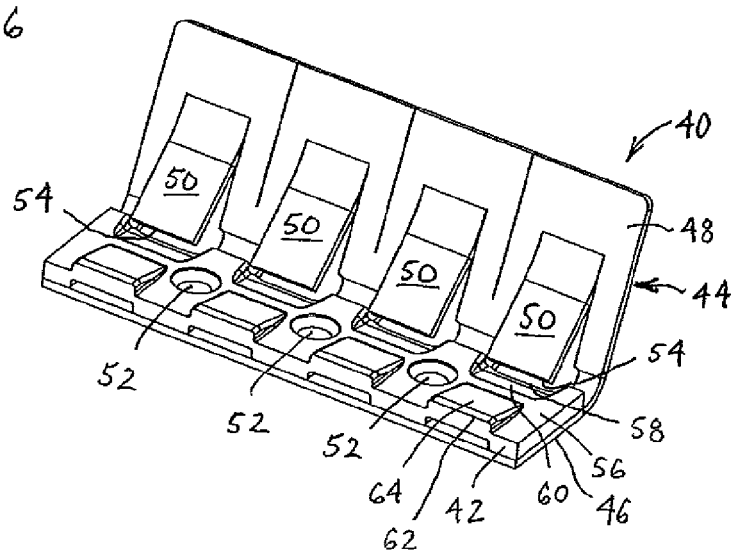
FIG. 6 is a perspective of the terminal assembly of the socket assembly shown in FIG. 1.
Figure 7:
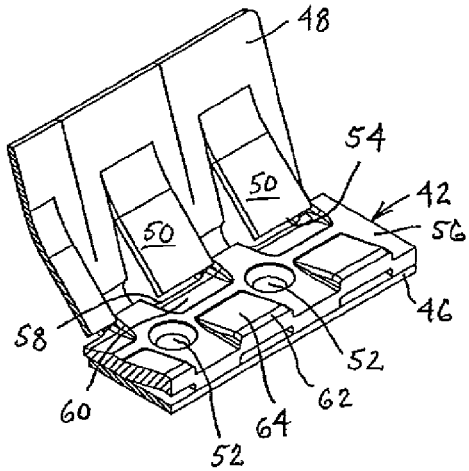
FIG. 7 is a sectional perspective view of the terminal assembly shown in FIG. 6.

Enclosed by the connector housing 20 and housing connector caps 30 are example terminal assemblies 40. Each terminal assembly 40 includes a busbar 42 supported on a spring member 44. The spring member 44 includes a foot 46 joined to an upstanding leg 48 and individual depending spring fingers 50. The foot 46 includes apertures (not shown) for receiving rivets 52 formed from the busbar 42 to connect the busbar 42 to the foot 46. Each depending spring finger 50 is integrally connected to the upstanding leg 48 and has a free end 54 at its opposite end. As seen in FIGS. 6 and 7 the spring fingers 50 are bent out of the plane of the upstanding leg 48. The free end 54 may be further angled somewhat relative to the remainder of the spring finger 50 to provide an optimum angle for gripping a wire inserted under the spring finger 50. The spring member 44 is preferably formed of a resilient metal such as stainless steel.

With the terminal assembly 40 in place, all but one of the spring fingers 50 of upstanding leg 48 is opposite a wire entry port 32 so that a conductor of stripped end of a wire (not shown) may be inserted into a wire entry port 32 to encounter the spring finger 50 and move it upwardly as the conductor enters the connector housing 20. The free end 54 of the spring finger 50 will press on the conductor, preventing it from pulling out of the connector housing 20 and pushing it into firm engagement with the top face 56 of the busbar 42. As noted, one of the spring fingers 50 is not opposite a wire entry port 32, and instead is opposite to and engages a blade 28 extending from a contact 26. Thus, in this example, each terminal assembly 40 is connected to a contact 26 within the socket assembly 10 and is configured for push-in termination of a conductor of one or more wires via one or more spring fingers 50. As noted above, it will be appreciated that each busbar may incorporate a contact or other electrical engagement configuration to accommodate an alternative configuration of a lamp or bulb base.

In the first illustrated example, the busbar 42 is a generally rectangular member made of tin-plated copper. The top face 56 of the busbar 42 includes an entry edge 58 at a depression 60 and an exit edge 62 at a protrusion 64. It will be understood that terms such as "top" and "bottom" are used herein for reference purposes only, as there is nothing inherent in the orientation of the busbar 42 that would make one side or the other of the busbar 42 a top, bottom, left or right portion. As used herein the entry edge 58 will be considered the edge of the busbar 42 first crossed by a conductor entering the connector housing 20 and the exit edge 62 will be considered the edge of the busbar 42 potentially thereafter crossed by an entering conductor. It can be seen that the depression 60 and protrusion 64 may be used to form a serpentine path for the conductor to traverse over the top face 56 of the busbar 42. This configuration helps the spring finger 50 retain the conductor in the connector housing 20. Depending on the diameter of the conductor, the depression 60 may surround the conductor at least partially on three sides, such as to prevent splaying of the conductive stripped end of a stranded wire.

Within the spring assembly having two different metals, the busbar 42 has a thickness and is connected to the foot 46 of the spring member 44 by rivets 52 that are formed by upsetting a portion of the busbar 42 or may be provided as separate fasteners. It will be understood that other methods for connecting the busbar 42 to the spring member 44 may be used, such as crimping, adhesives or the like. Alternatively, the busbar 42 may not be fixed to the spring at all. Rather, it could be otherwise supported by the connector housing 20.

Figure 7A:
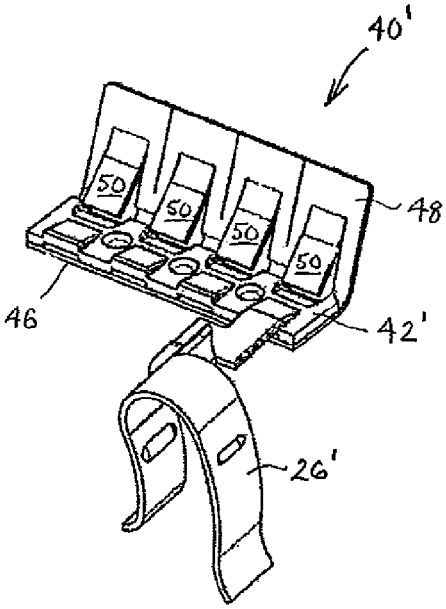
FIG. 7A is a top perspective view of an alternative example terminal assembly that includes a contact for electrical engagement with a conductor on a lamp base.
Figure 10:
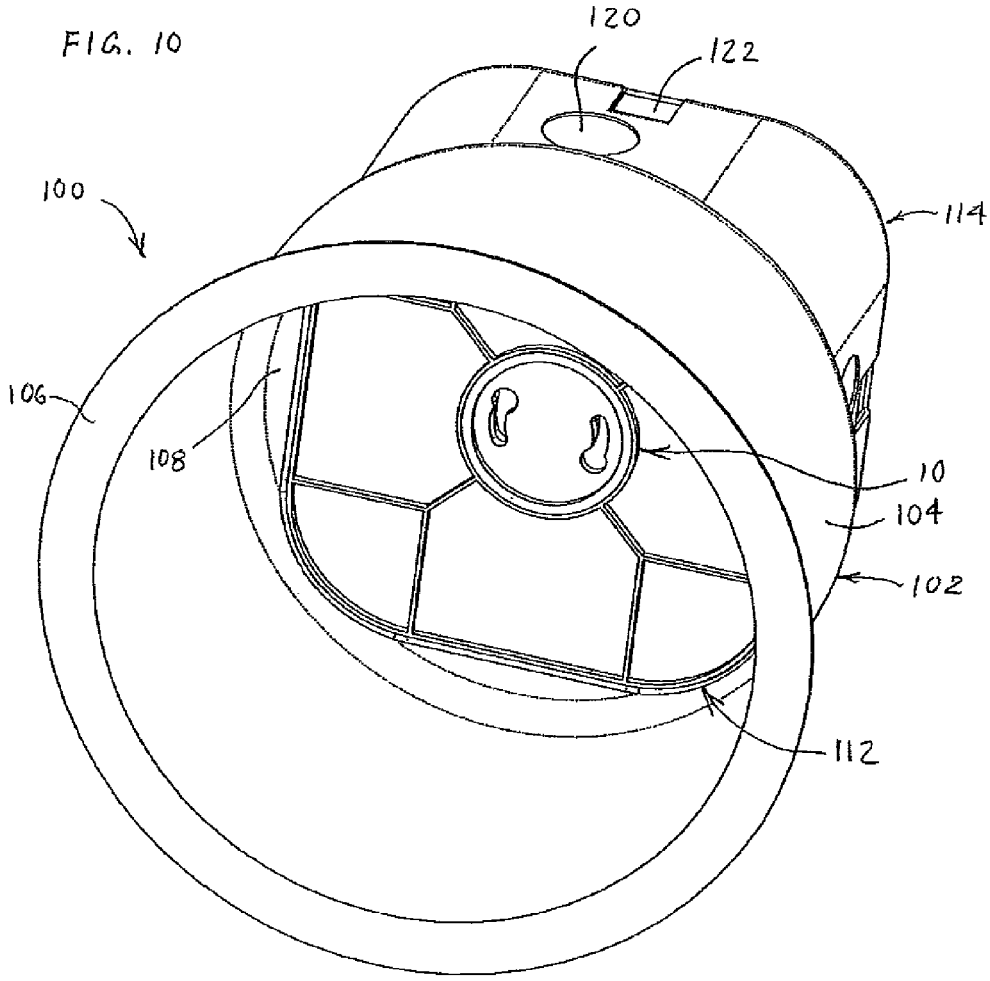
FIG. 10 is a bottom perspective view of a first example of a light fixture including a socket assembly in a cover assembly that is in the form of an interior door and having an integrated junction box.
Figure 11:
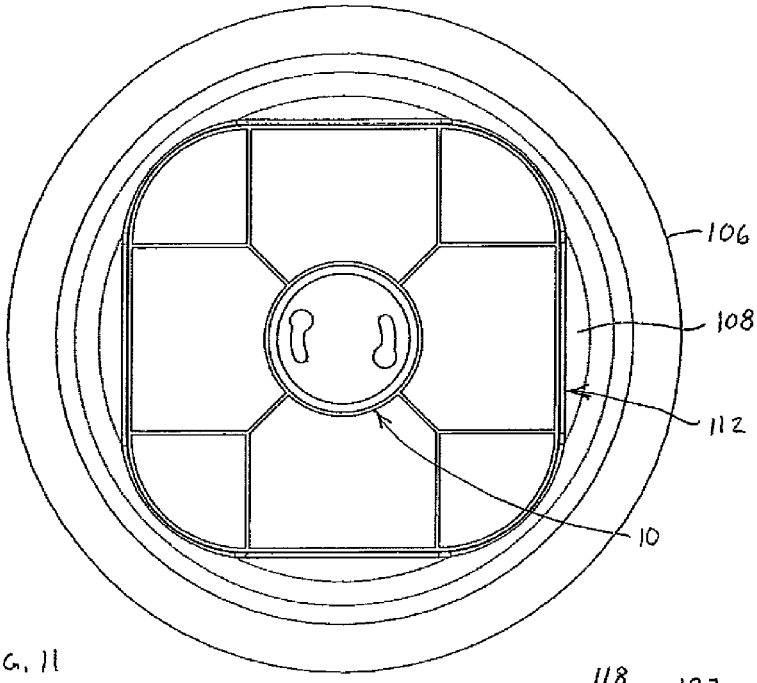
FIG. 11 is a bottom plan view of the light fixture shown in FIG. 10.
Figure 12:
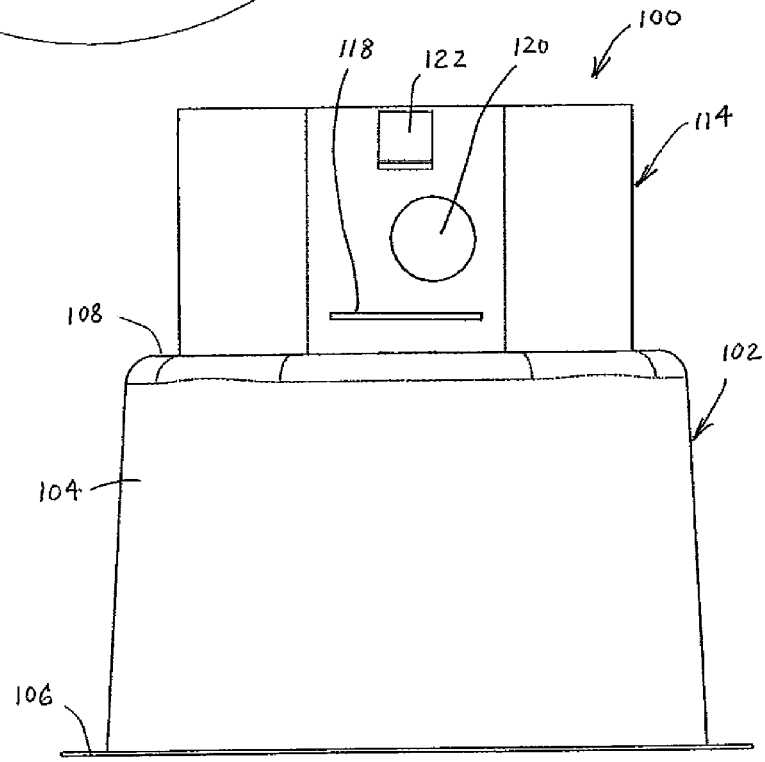
FIG. 12 is a side elevation view of the light fixture shown in FIG. 10.
Figure 13:
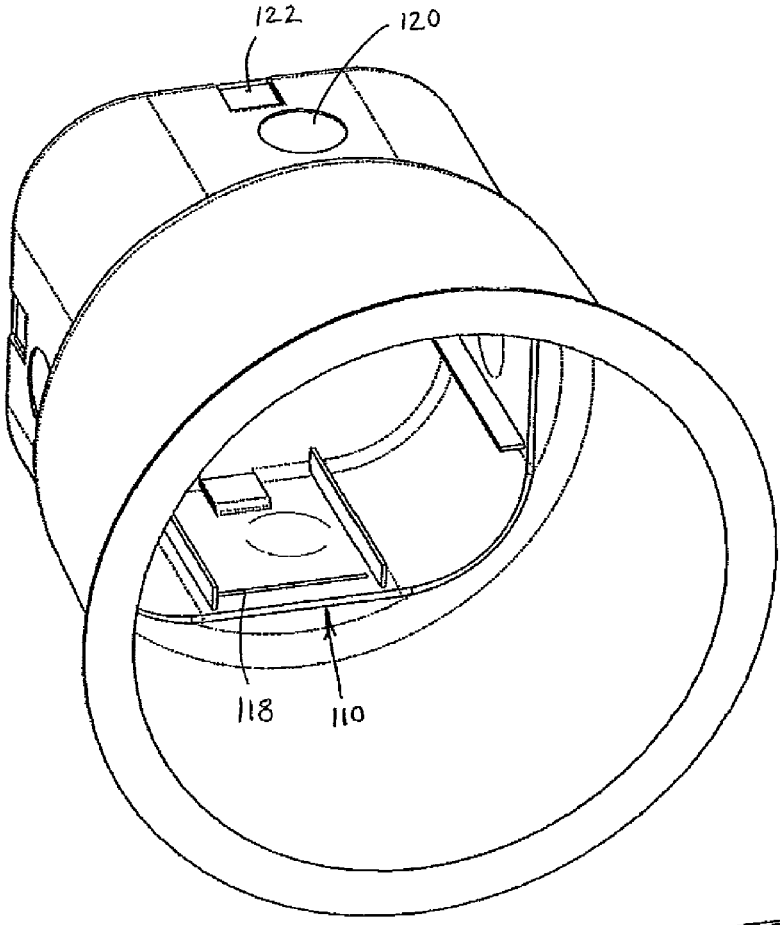
FIG. 13 is a perspective exploded view of the light fixture shown in FIG. 10 with the cover assembly removed.
Figure 13:
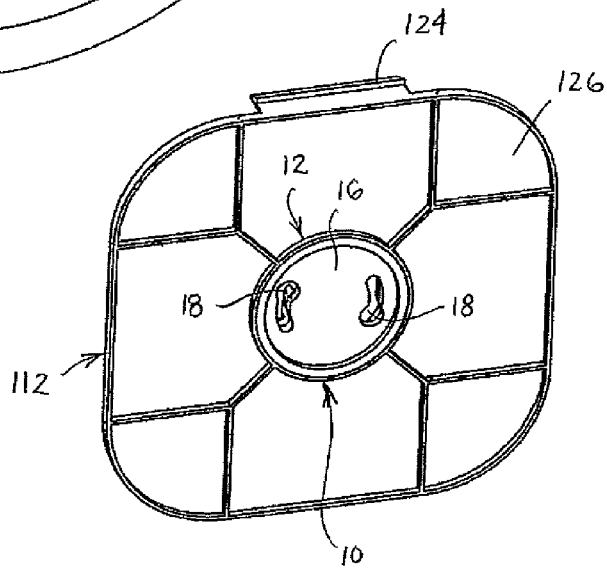
Figure 14:
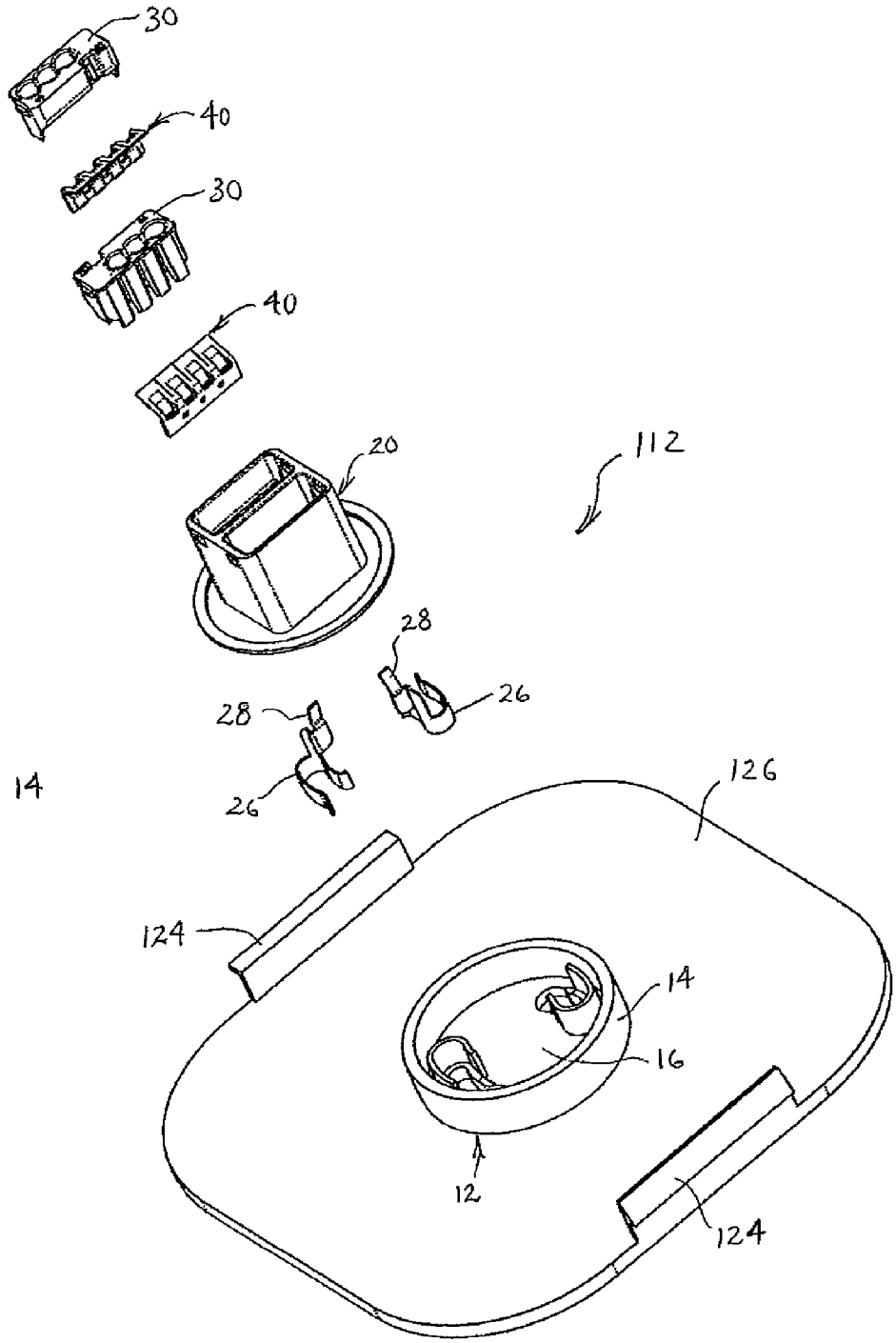
FIG. 14 is a top perspective exploded view of the cover assembly in the form of an interior door and socket assembly of the light fixture shown in FIG. 10.
Figure 15:
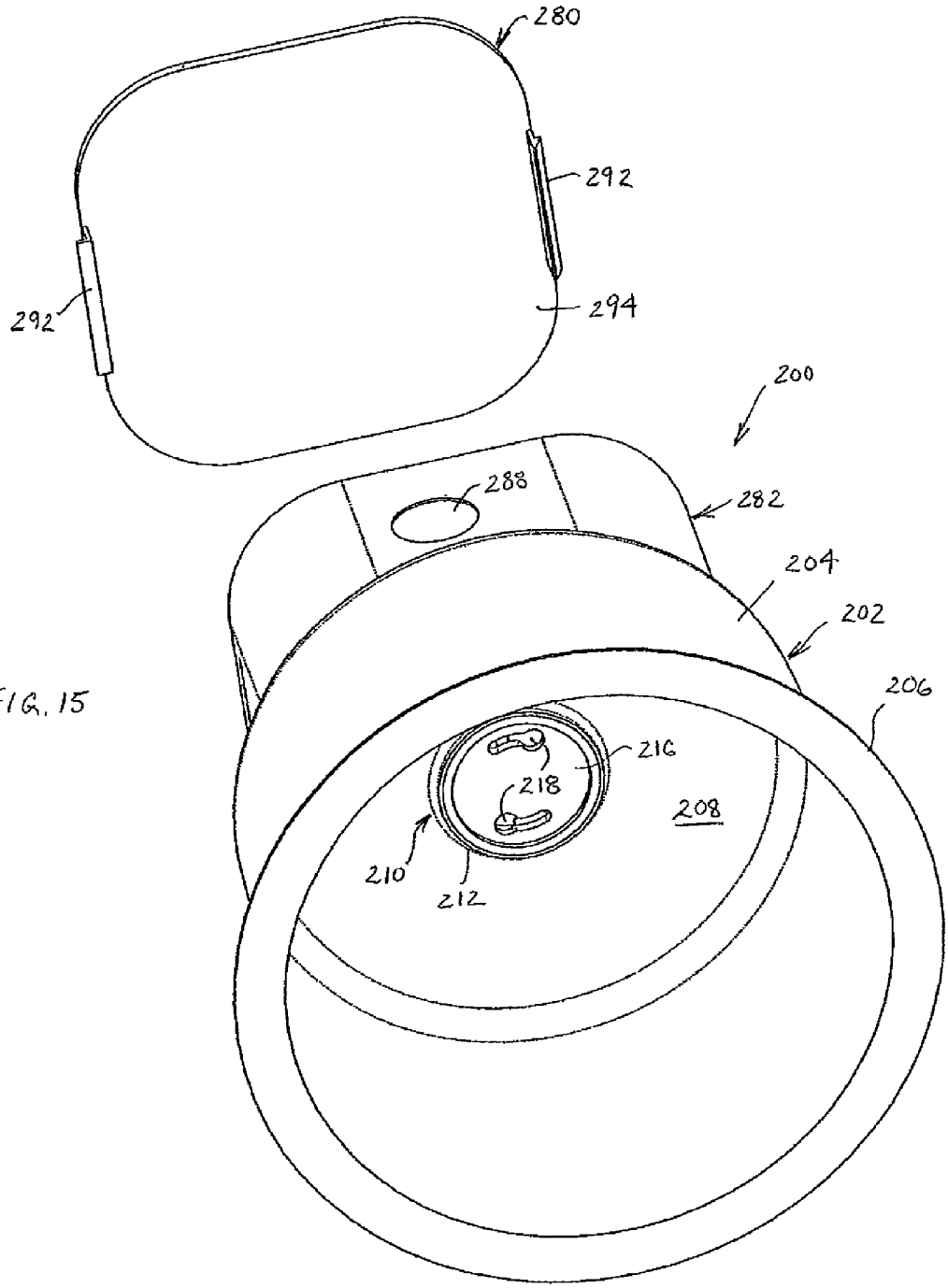
FIG. 15 is a bottom perspective exploded view of a second example of a light fixture including a socket assembly integrated into an interior wall and having a cover for an integrated junction box.
Figure 16:
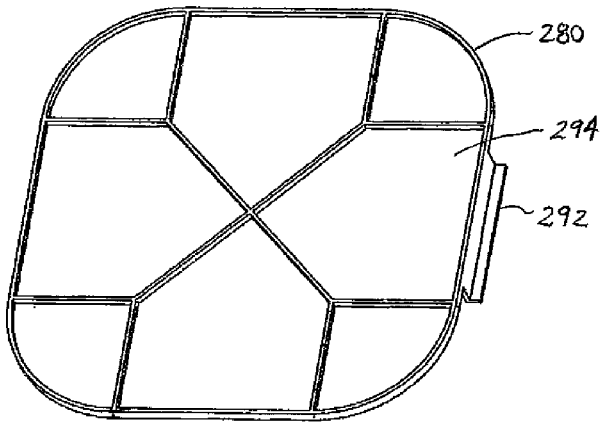
FIG. 16 is a top perspective exploded view of the light fixture shown in FIG. 15.
Figure 16:
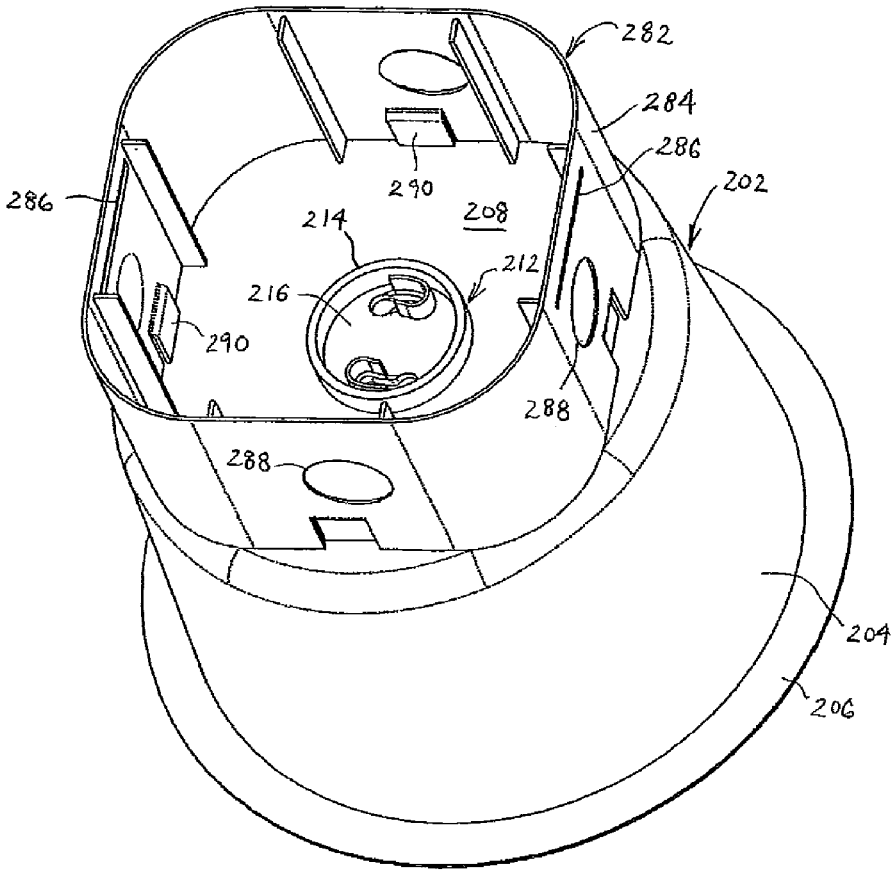
Figure 17:
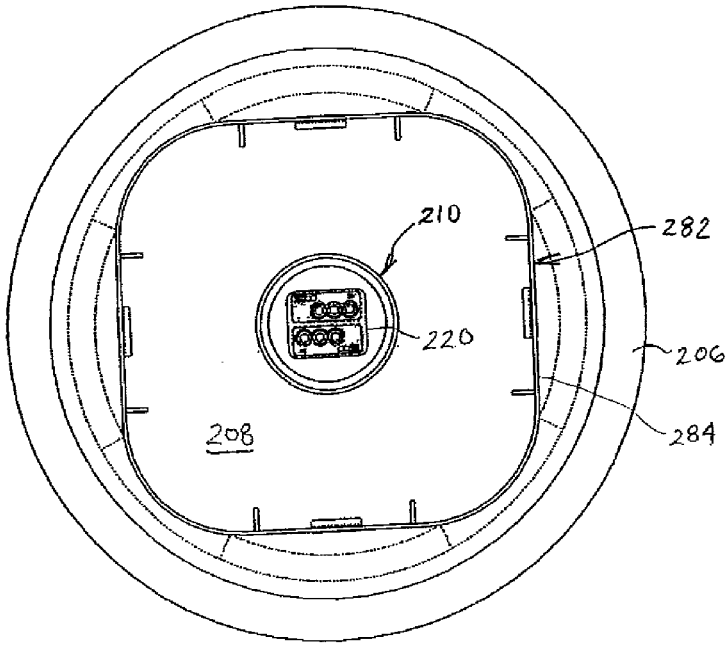
FIG. 17 is a top plan view of the light fixture shown in FIG. 15 with the cover removed.
Figure 18:
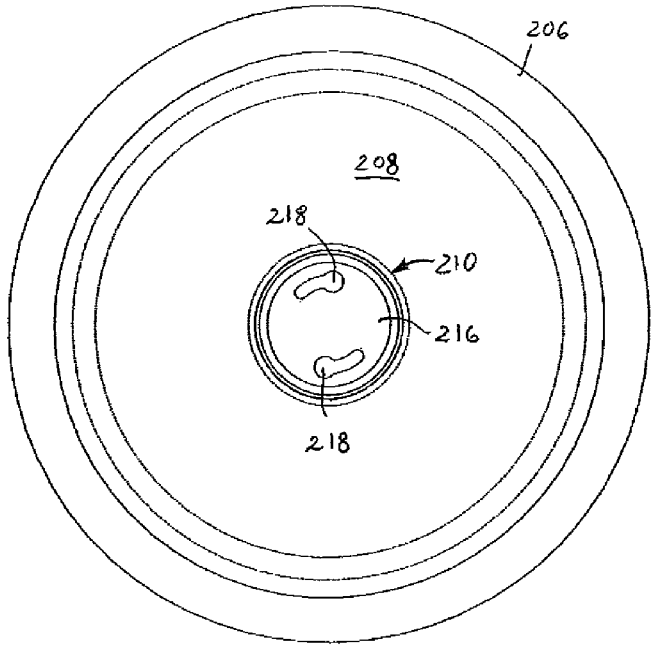
FIG. 18 is a bottom plan view of the light fixture shown in FIG. 15.
Figure 19:
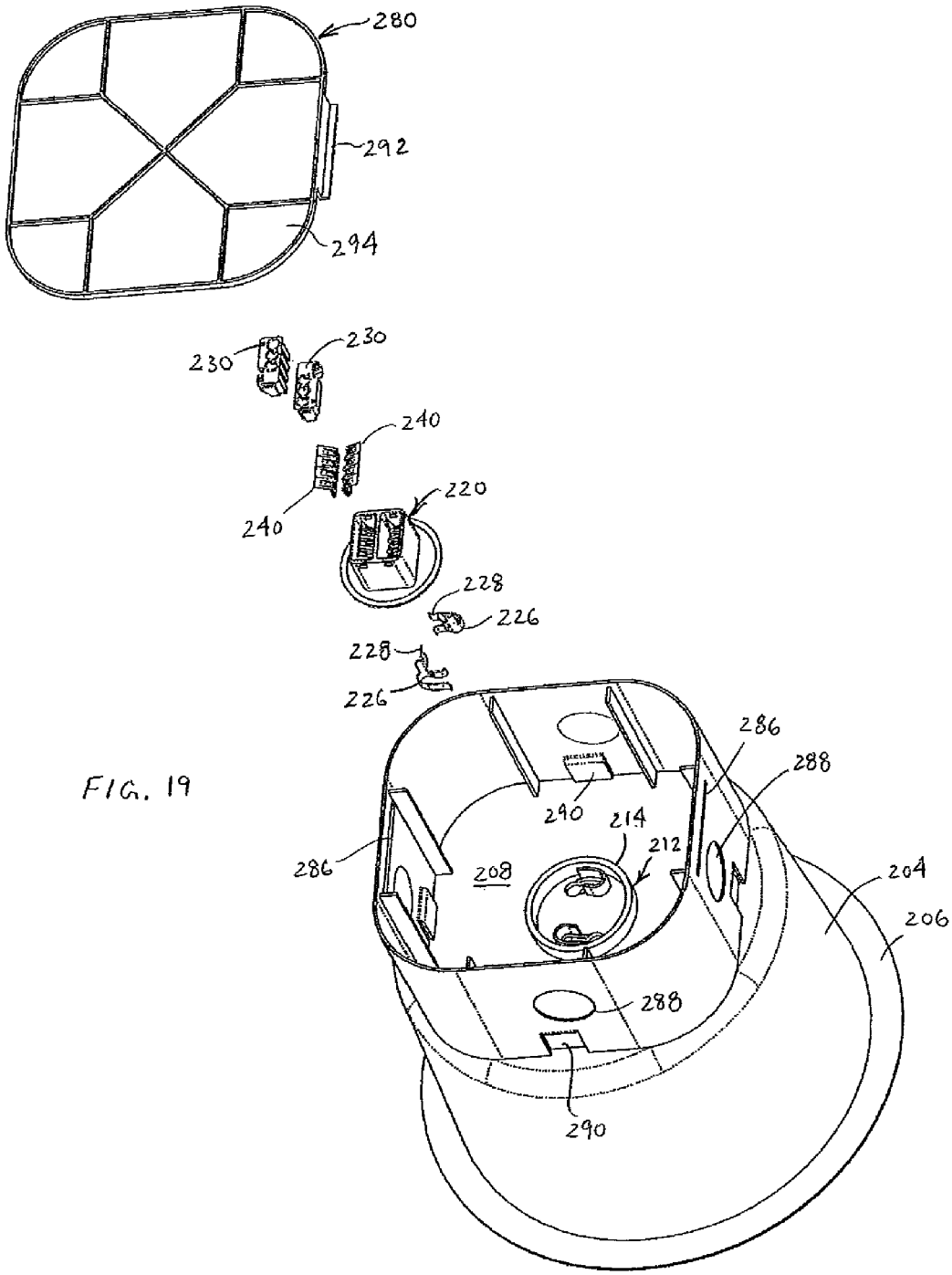
FIG. 19 is a top perspective exploded view of the light fixture shown in FIG. 15.

In an alternative terminal assembly construction shown in FIG. 7A, the busbar 42 may be replaced by a further example busbar 42' that includes an integral contact 26', which serves to replace the combination of the above-described busbar 42 and contact 26. Thus, an alternative terminal assembly 40' is of somewhat similar construction in that it includes a foot 46 joined to an upstanding leg 48 and individual depending spring fingers 50. However, the connection between the blade 28 of a contact 26 with a spring finger 50 and busbar 42 of the first example is effectively replaced by the busbar 42' having an integral contact 26' that is configured to receive a conductor of a lamp base. The remainder of the construction of the terminal assembly 40' is similar to that of the first example terminal assembly 40, such as with respect to the materials and means of connection within the assembly.

For ease of use and the ability to disconnect and reconnect conductors of wires, such as the conductor of a stripped end of a wire, the socket assemblies may be adapted to receive zero insertion force termination. For example, FIGS. 8 and 9 provide an alternative example socket assembly that is similar to that of FIGS. 1-7, but also includes wire port inserts 70, each of which snaps into and is slidably received in one of the wire entry ports 32. Each wire port insert 70 includes a body 72 having a through port 74 and an extension 76. The extension 76 is configured to engage the rear surface of a spring finger 50 when depressed inwardly, so as to move the spring finger 50 further away from the top surface 56 of the busbar 42, thus clearing the way for insertion of a conductor of a wire or relieving the grip on a previously inserted wire. Thus, use of the inserts 70 provides a zero insertion force option for a respective conductor and permits the spring finger to be displaced to freely allow removal of the conductor, if desired.

It will be noted that in this example, the wire entry ports 32 and busbar 42 are arranged such that the busbar 42 is disposed at about a 17° angle to an entry axis of the wire ports 32. That is, in this example, the busbar 42 with the depressions 60 is configured to be held at an angle of about 17° and somewhat interferes with the path of the inserted conductors to create a bump and/or angled surface for the conductor to pass over as the spring fingers of the spring member 44 press the conductors into the busbar top face 56, further directing the conductors over the bump or angled surface provided by the protrusions 64. This enhances both the holding force of the spring finger 50 and the electrical contact between the busbar 42 and the conductor.

The socket assemblies of this disclosure may be utilized in integrated light fixtures, with such fixtures being adapted to receive a lamp base and including a plurality of terminal assemblies. Each of the terminal assemblies has two or more metal component, with each terminal assembly being adapted to receive push-in terminations. Turning to FIGS. 10-14, an example of such a light fixture is illustrated in a light fixture 100 having a lamp housing 102 with a side wall 104 ending in an outward extending lip 106 for ease of installation along a surface of a ceiling (not shown). The lamp housing 102 further includes a top wall 108 having an aperture 110 with a removable cover assembly 112 in the form of an interior door by which one can gain access to a junction box 114, which may be formed in an integral manner. It will be understood that while the lamp housing 102 is shown in a relatively cylindrical shape, it may have alternative shapes or configurations and the cover assembly and junction box alternatively could be located along a side wall of the lamp housing. The junction box 114 in this example includes side walls 116 having slots 118, knock outs 120 (for receiving flexible or rigid conduit) and foldable flap closures 122 (for receiving and retaining in place flexible wiring such as Romex). The slots 118 receive tabs 124 that extend from a body portion 126 of the cover assembly 112. The cover assembly 112 may have alternative shapes and sizes and may be connected to the lamp housing or junction box 114 via other methods and components, such as by hinging, latching or use of removable fasteners or the like. As with respect to the lamp housing 102, it will be understood that the junction box may have alternative shapes and configurations and may be located along a side wall of the lamp housing.

In this example, mounted in the center of the body portion 126 of the removable cover assembly 112 is a socket assembly 10, as disclosed above with respect to FIGS. 1-7. This is best appreciated when viewing FIG. 14. Also, it will be appreciated that the light fixture 100 may be formed of many different materials cost effectively, such as molded plastic or sheet metal, and that the junction box 114 may be joined to or integrated into the construction of the lamp housing 102 to form a single piece unit. This presents a cost effective assembly while providing full access to the wiring and socket assembly 10 via its connection or incorporation into the removable cover assembly 112, even after installation of the light fixture 100 in a ceiling.

It will be appreciated that, while not shown, for any of the light fixtures illustrated within this disclosure, a portion of the lamp housing may be metalized or otherwise coated for heat dissipation and/or optical reflectance and/or a reflector, lens and trim ring may be added. Similarly, while not shown, a heat sink may be included within the light fixture and it will be understood that a ballast, driver or other electronic device may be mounted on the lamp housing or junction box, as desired.

FIGS. 15-19 illustrate a further example light fixture 200 having a lamp housing 202 with a side wall 204 ending in an outward extending lip 206 for ease of installation along a surface of a ceiling (not shown). The lamp housing 202 further includes a top wall 208 having an integrally formed base 212 of a socket assembly 210 in a centrally located position. Aside from its integral base, this example socket assembly 210 is otherwise constructed in a manner similar to socket assembly 10 shown in FIGS. 1-7, with correspondingly numbered components. Once again, alternative socket configurations could be utilized to accommodate particularly selected lamps or bulbs having different base constructions and the terminal assembly and contacts may be integrated in alternative configurations that include at least two metal components.

In this example, a removable cover 280 is provided to gain access to an integral junction box 282. The junction box 280 includes side walls 284 having slots 286, knock outs 288 (for receiving flexible or rigid conduit) and foldable flap closures 290 (for receiving and retaining in place flexible wiring such as Romex). The slots 286 receive tabs 292 that extend from a body portion 294 of the cover 280. However, as with the prior example, it will be understood that the lamp housing and junction box may have other shapes and configurations. Similarly, the cover 280 may have alternative shapes and sizes and may be connected to the lamp housing or junction box via other methods and components, such as by hinging, latching or use of removable fasteners or the like.

In this example, integrated into the center of the top wall 208 is the socket assembly 200, and the removable cover 280 is connected at the top end of the junction box 282. The socket assembly 210 includes an upper connector housing 220 that is accessible by removal of the cover 280, which is best appreciated in FIG. 17. As with the prior example light fixture 100, it will be appreciated that the light fixture 200 may be formed of many different materials cost effectively, such as molded plastic or sheet metal, and that the junction box 282 may be joined to or integrated into the construction of the top of the lamp housing 202 to form a single unit. This presents an alternative cost effective assembly while providing full access to the wiring and socket assembly 210 via its connection to or incorporation into the top wall 208 of the lamp housing 220 and the removable cover 280.

Figure 20:
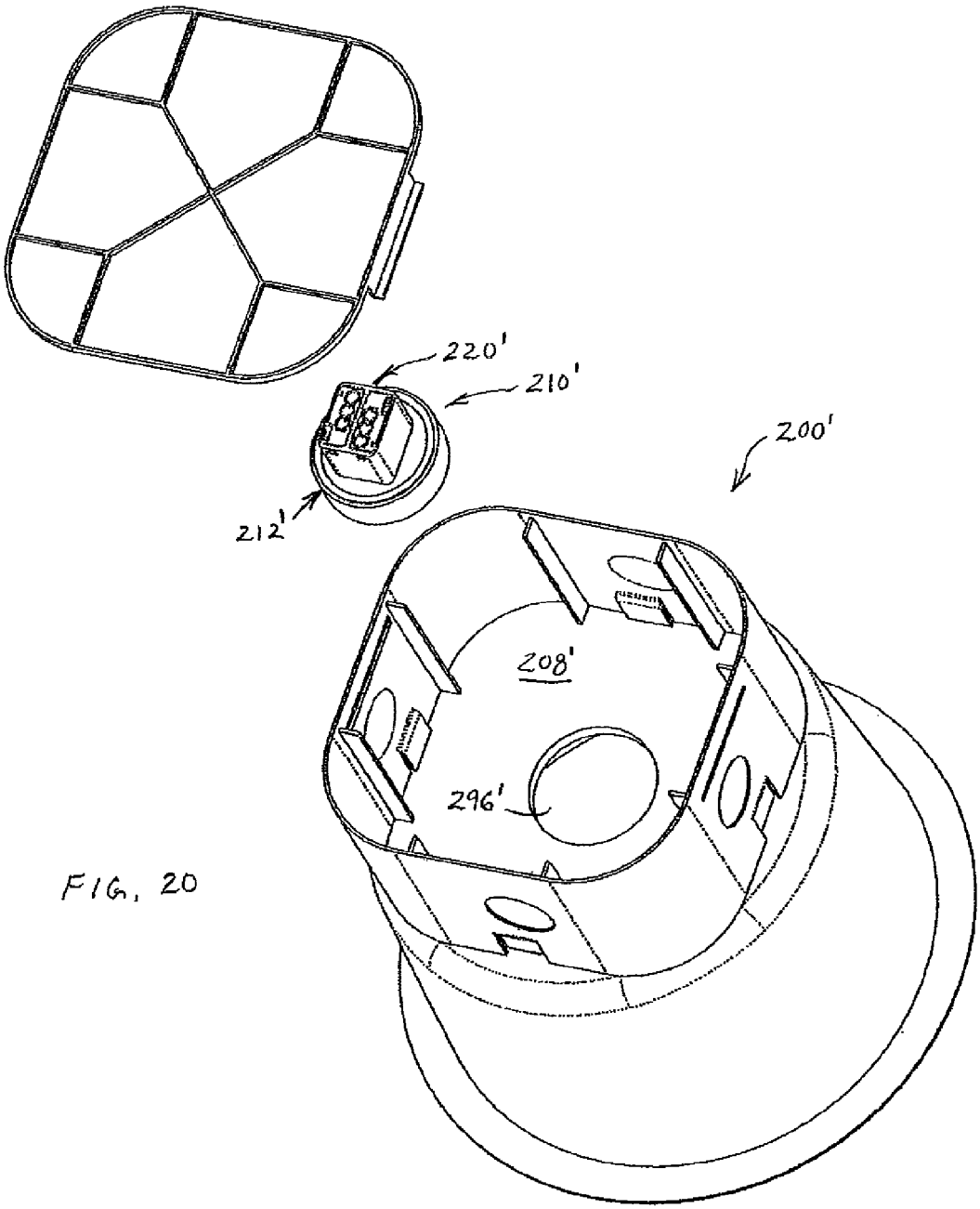
FIG. 20 is a top perspective view of a further example light fixture similar to that which is shown in FIG. 15 but without the socket assembly base integrally formed within an interior wall.

FIG. 20 illustrates an alternative light fixture 200' which is similar in all respects to the above-discussed light fixture 200, except that the base 212' of the socket assembly 210' is not integrally formed with the top wall 208' of the lamp housing 220'. Instead, the top wall 208' includes an aperture 296' into which the base 212' of the socket assembly 210' is mounted, such as by snap fit, adhesive or other suitable joining methods. Thus, in this example, the socket assembly 210' is more like socket assembly 10 that is described above in detail.

Figure 21:
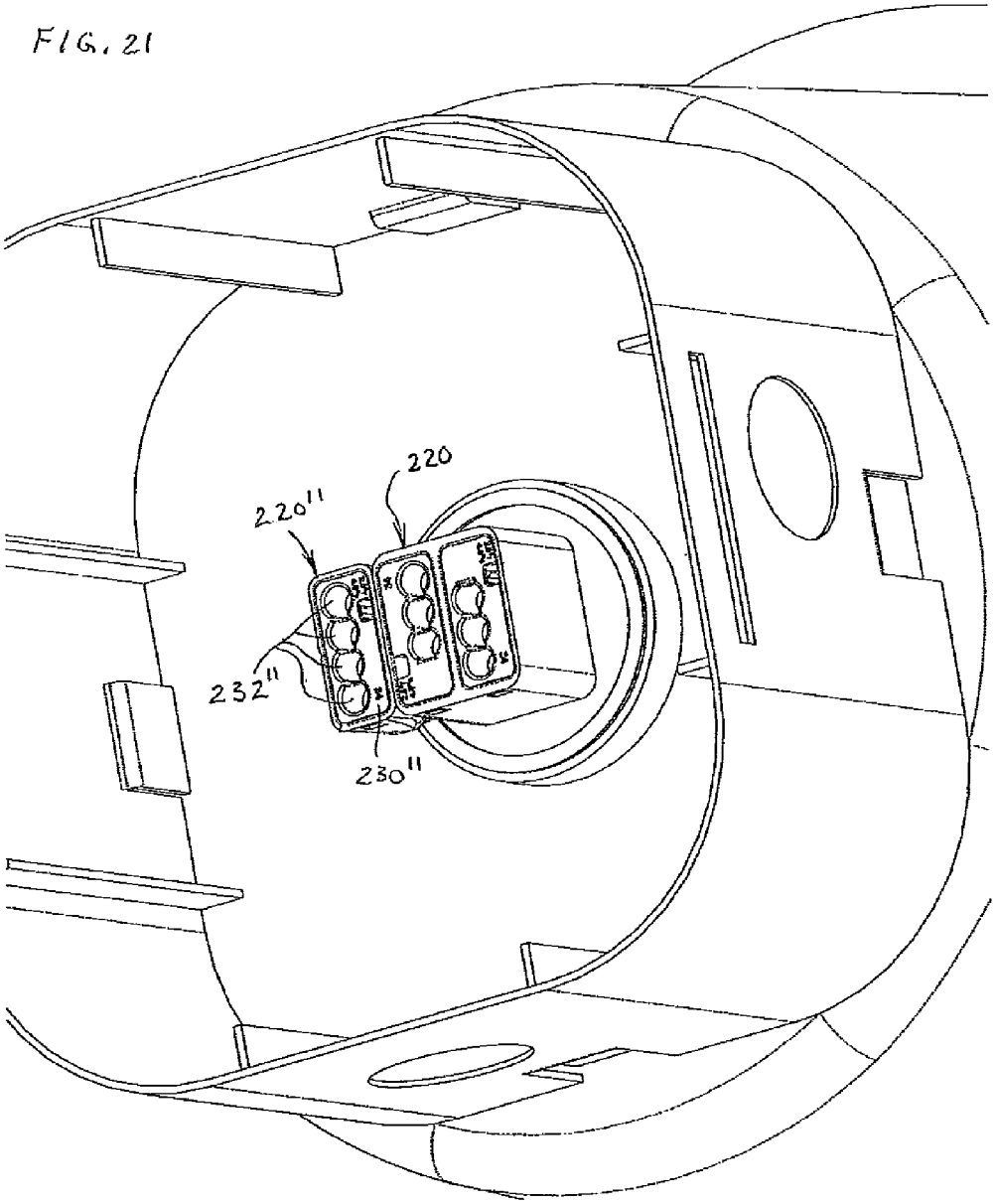
FIG. 21 is a top perspective view of an alternative example of a socket assembly within the light fixture shown in FIG. 15 and further including a Ground circuit.

FIG. 21 illustrates a closer view of a light fixture 200" which is similar to the light fixture 200 described above with respect to FIGS. 15-19, but includes a modified version of the socket assembly 210" having an additional Ground wire circuit. The Ground wire circuit is provided via inclusion of a further connector housing 220" adjacent the previously described connector housing 220. The additional connector housing 220" includes a housing wall 224, housing connector cap 230" having Ground wire entry ports 232". The connector housing 220" provides one additional wire entry port 232" for connection of the socket assembly 220" to a grounding source.

FIGS. 22-27 illustrate an alternative example of a socket assembly 310 having a base 312 with a side wall 314 and a bottom wall 316. The bottom wall 316 includes a pair of arcuate, key-hole shaped apertures 318. Joined to the base 312 is a connector housing 320 having a cover portion 322 and separate upstanding side walls 324. Enclosed between the bottom wall 316 of the base 312 and the connector housing 320 are contacts 326 for connection to posts or pins of lamp base, such as posts 29 of the bulb 25 in FIG. 2A, although as noted above, alternative constructions that would be suitable to accommodate different lamp or bulb bases may be utilized.

In this example, the contacts 326 include a body 328, lamp base engaging portions 330 and plug engaging blades 332. The body 328 of the contacts 326 are held in position relative to the apertures 318 by upstanding slotted members 334 that are formed on the bottom wall 316. Thus, the slots 336 receive and locate a portion of the body 328 of the contacts 326 to hold them in position for engagement with a lamp (not shown) and to locate the respective engaging blades 332 within the respective upstanding side walls 324.

Figure 22:
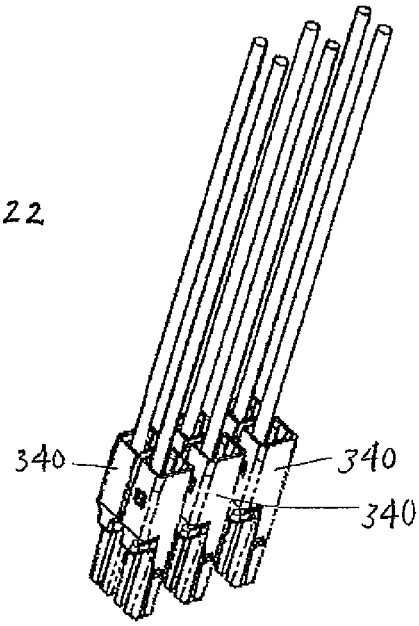
FIG. 22 is a top perspective view of another example socket assembly, with the socket assembly including a plug-in connector to receive wires that are terminated in plugs.
Figure 22:
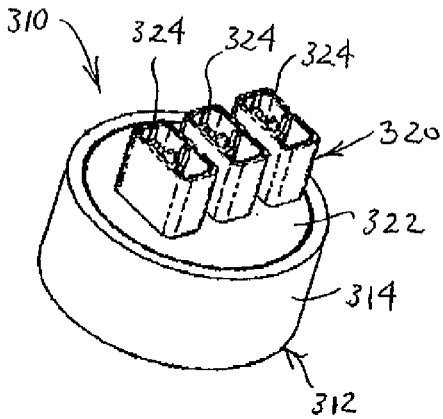
Figure 23:
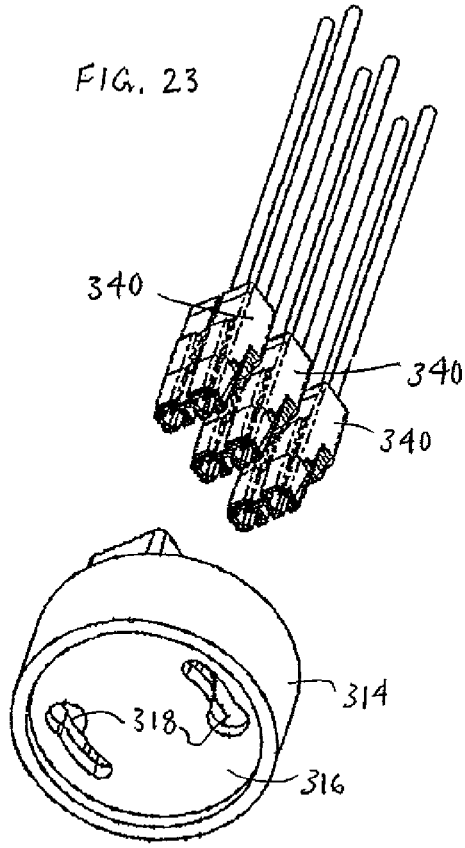
FIG. 23 is a bottom perspective view the socket assembly and wires shown in FIG. 22.
Figure 24:
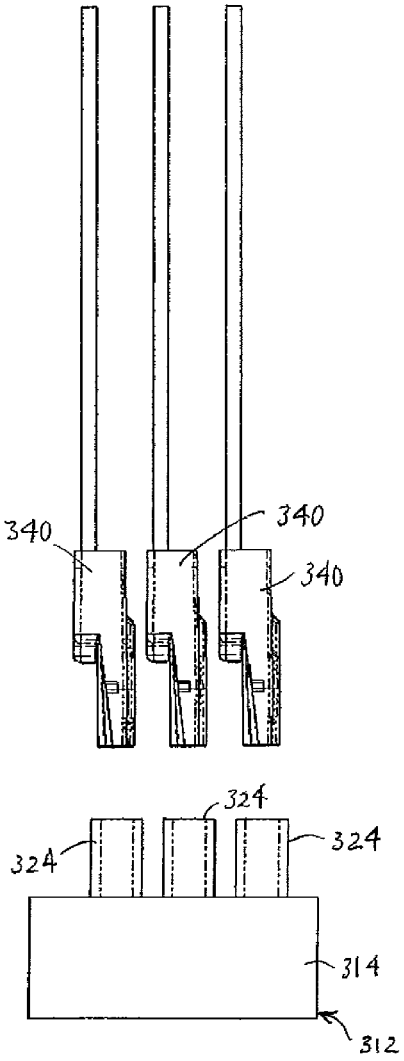
FIG. 24 is a side elevation view of the socket assembly and wires shown in FIG. 22.
Figure 25:
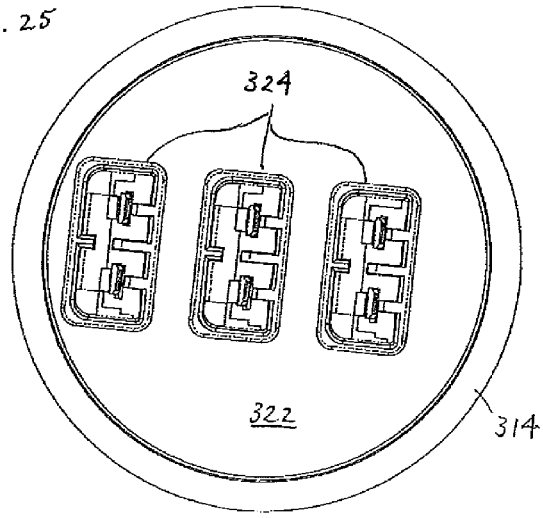
FIG. 25 is a top plan view of the socket assembly shown in FIG. 22.
Figure 26:
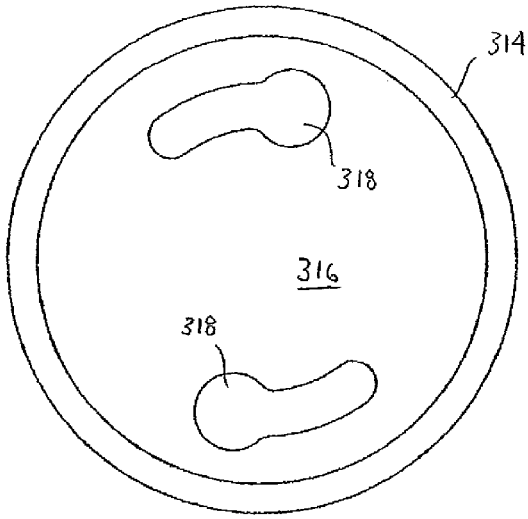
FIG. 26 is a bottom plan view of the socket assembly shown in FIG. 22.
Figure 27:
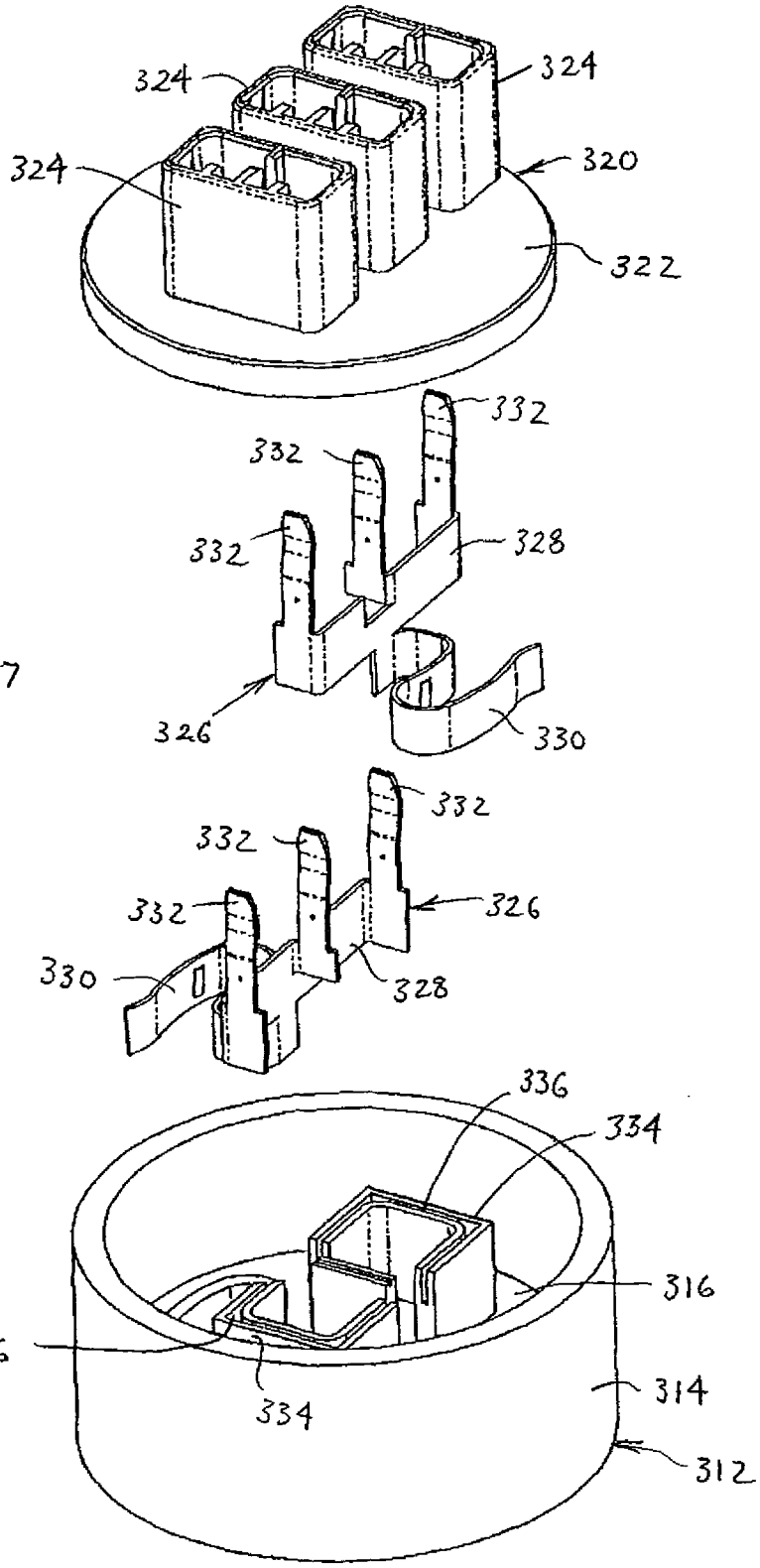
FIG. 27 is a top perspective exploded view of the socket assembly shown in FIG. 22.

As shown in FIGS. 22-24, the socket assembly 310 is configured to receive wire ends that are terminated in plugs 340. The plugs 340 are structured for mating engagement with the upstanding side walls 324 of the connector housing 320, and each plug includes a contact (not shown) that is joined to a conductor of a wire, such as by crimping or other suitable connection methods. This construction includes fewer components than the construction of socket assembly 10, but does not permit push-in wire connections.

Figure 28:
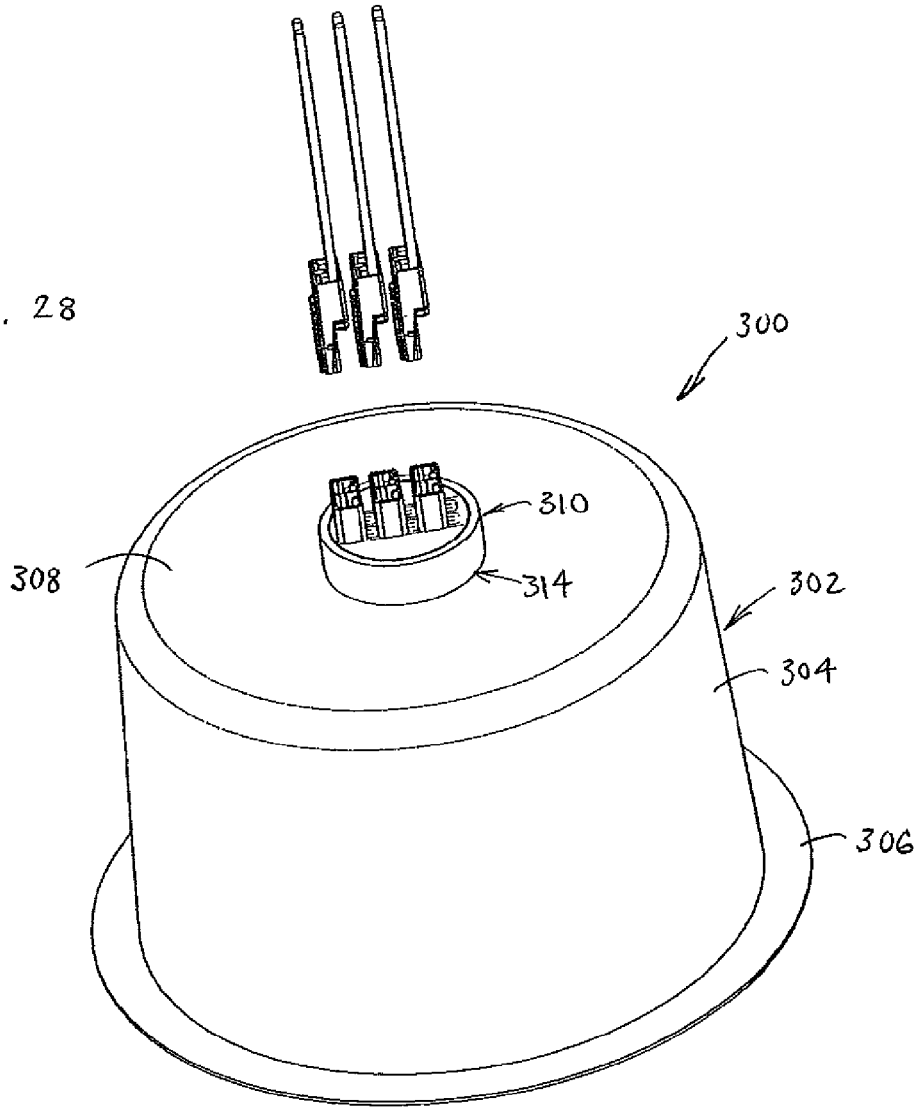
FIG. 28 is top perspective view of an example of a light fixture including the socket assembly shown in FIGS. 22-27.
Figure 30:
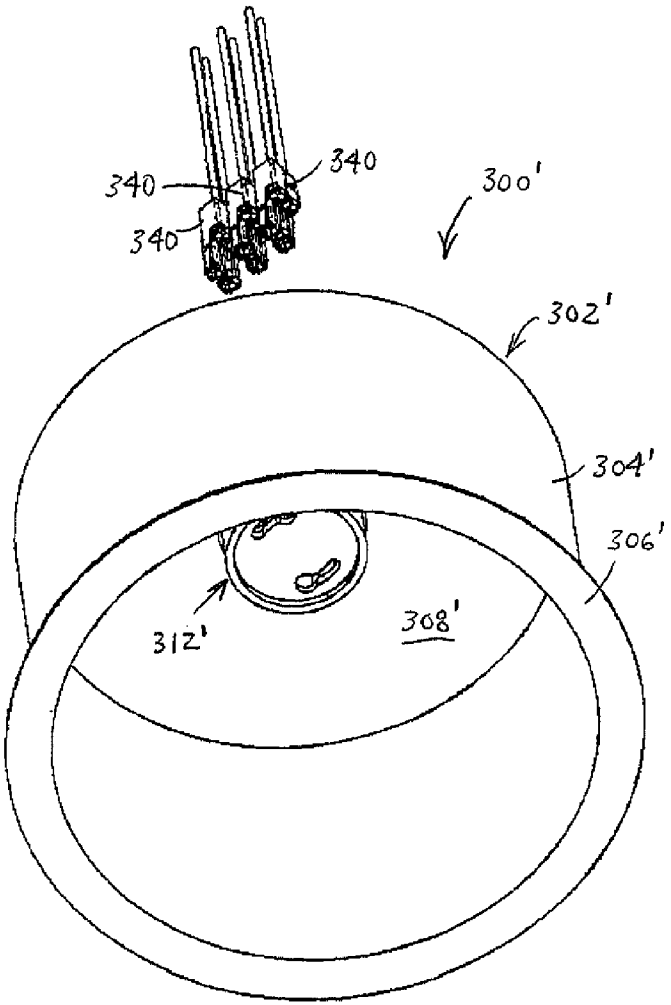
FIG. 30 is a bottom perspective view of the light fixture shown in FIG. 29.
Figure 29:
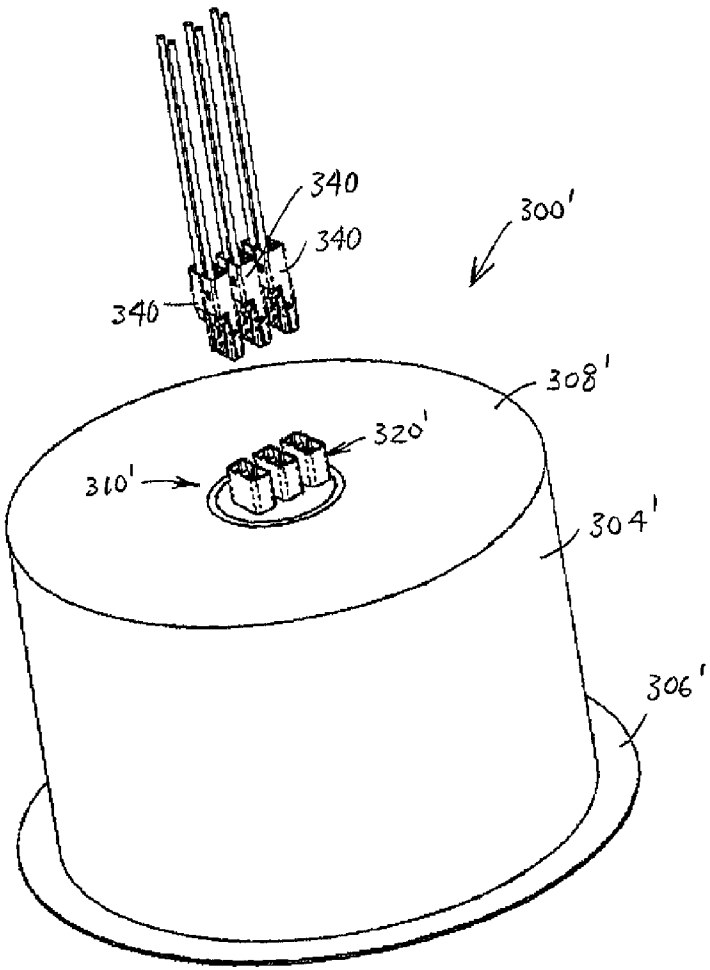
FIG. 29 is a top perspective view of an alternative example of a light fixture including an integrated version of the socket assembly shown in FIG. 22.
Figure 31:
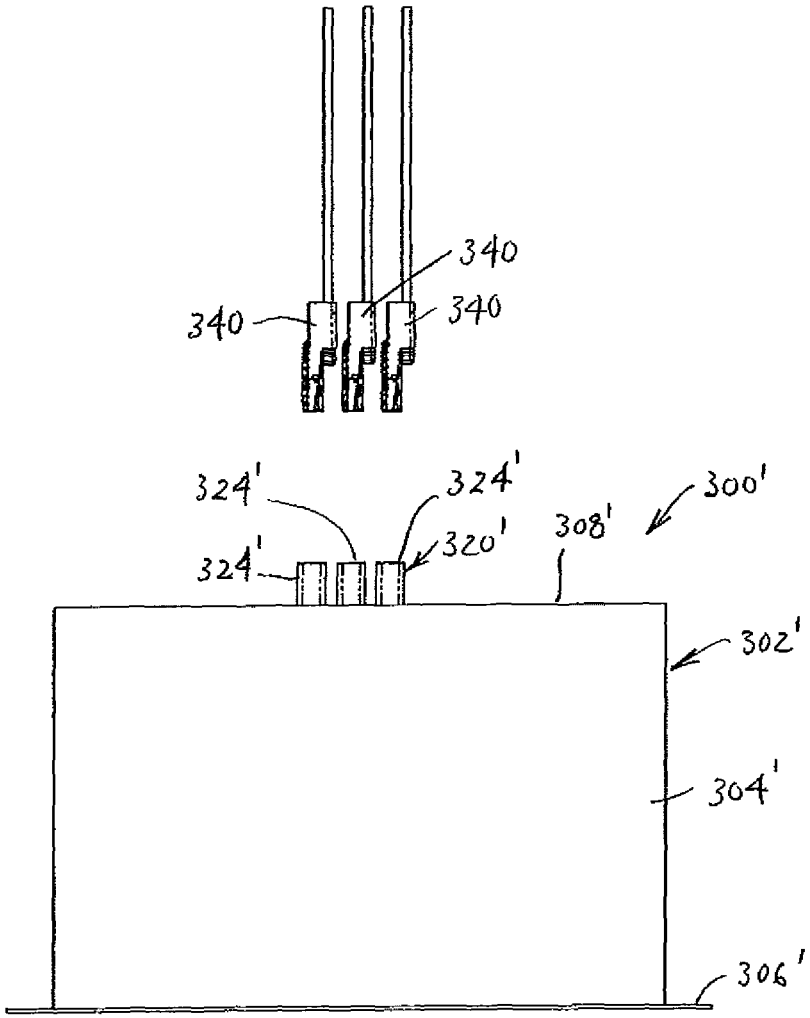
FIG. 31 is a side elevation view of the light fixture shown in FIG. 29.
Figure 32:
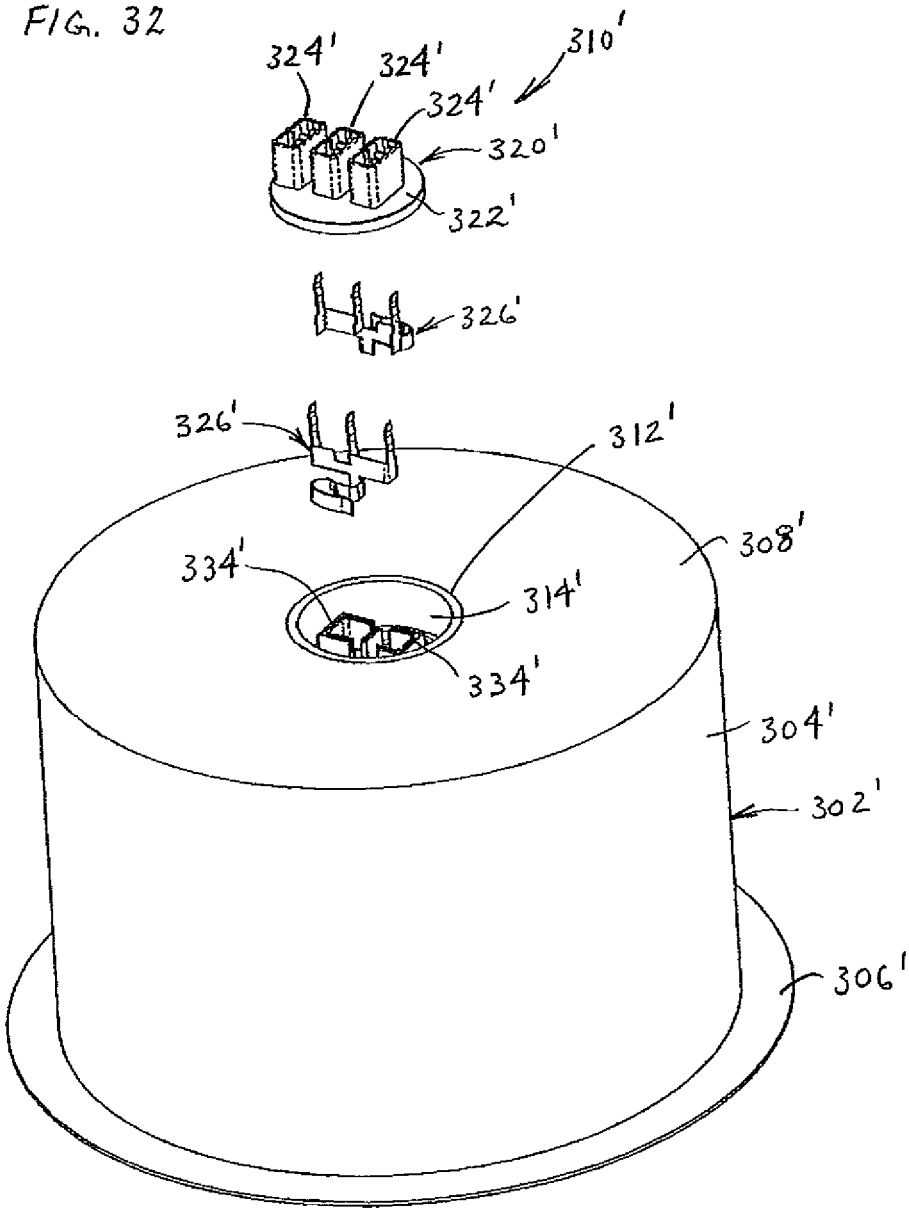
FIG. 32 is a top perspective exploded view of the light fixture shown in FIG. 29.
Figure 33:
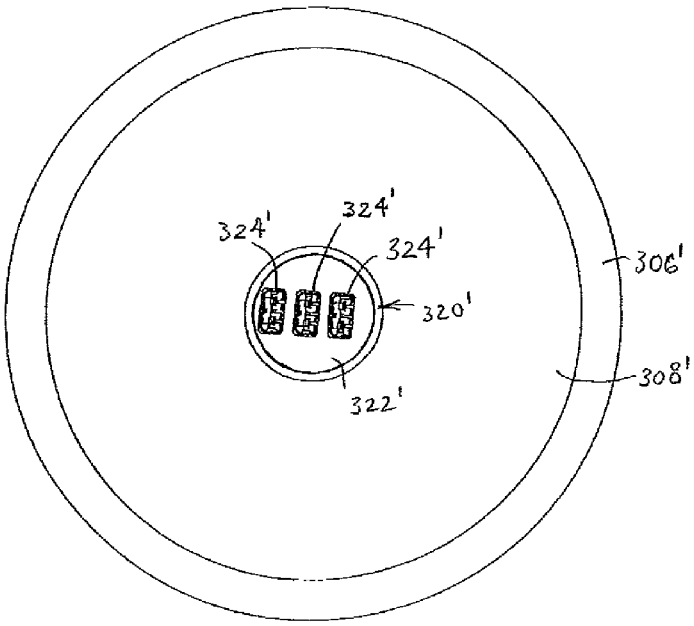
FIG. 33 is a top plan view of the light fixture shown in FIG. 29.
Figure 34:
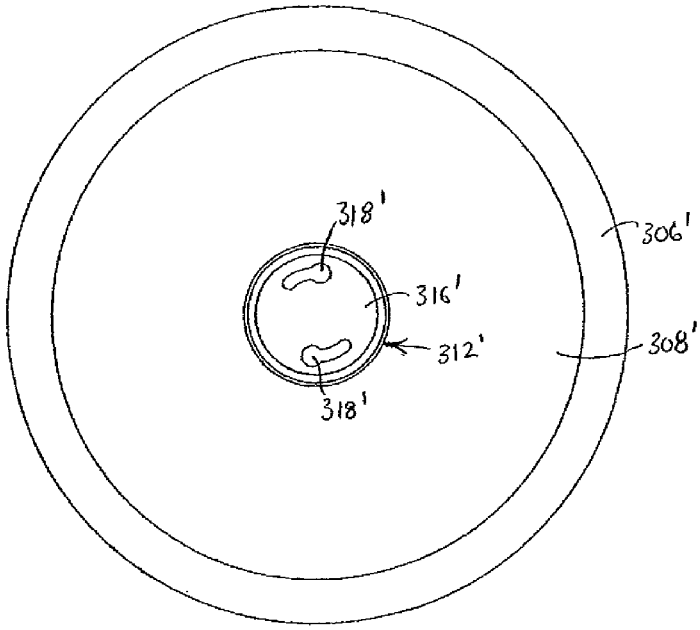
FIG. 34 is a bottom plan view of the light fixture shown in FIG. 29.

A further example alternative light fixture having a socket assembly is illustrated in FIG. 28, which shows a light fixture 300 having a lamp housing 302 with a side wall 304 ending in an outward extending lip 306 for ease of installation along a surface of a ceiling (not shown). The lamp housing 302 further includes a top wall 308 having an aperture 314 that receives a socket assembly 310 as described above, and with connection by snap fit or other suitable means. This provides a highly simplified light fixture construction by completely eliminating the junction box, and may be suitable in particular circumstances, such as DC power and/or low voltage installations.

FIGS. 29-34 illustrate an alternative example of a light fixture 300' to that shown in FIG. 28. The light fixture 310' includes a lamp housing 302' with a side wall 304' ending in an outward extending lip 306' for ease of installation along a surface of a ceiling (not shown). The lamp housing 302' further includes a top wall 308' having an integrally formed base 312' of a socket assembly 310'. The socket assembly 310' includes an integral base 312' with a side wall 314' and a bottom wall 316' with upstanding slotted members 334'. The bottom wall 316' includes a pair of arcuate, key-hole shaped apertures 318'. The socket assembly 310' is otherwise similar to the structure disclosed above with respect to the socket 310 of FIGS. 22-27, with correspondingly numbered components. Thus, joined to the base 312' is a cover portion 322 of a connector housing which has separate upstanding side walls 324, and enclosed within the base 312' are contacts 326 for engaging wire plug terminations to be electrically connected to posts or pins of lamp base. As with the prior example, the contacts 326 include a body 328, lamp base engaging portions 330 and plug engaging blades 332.

Figure 35:
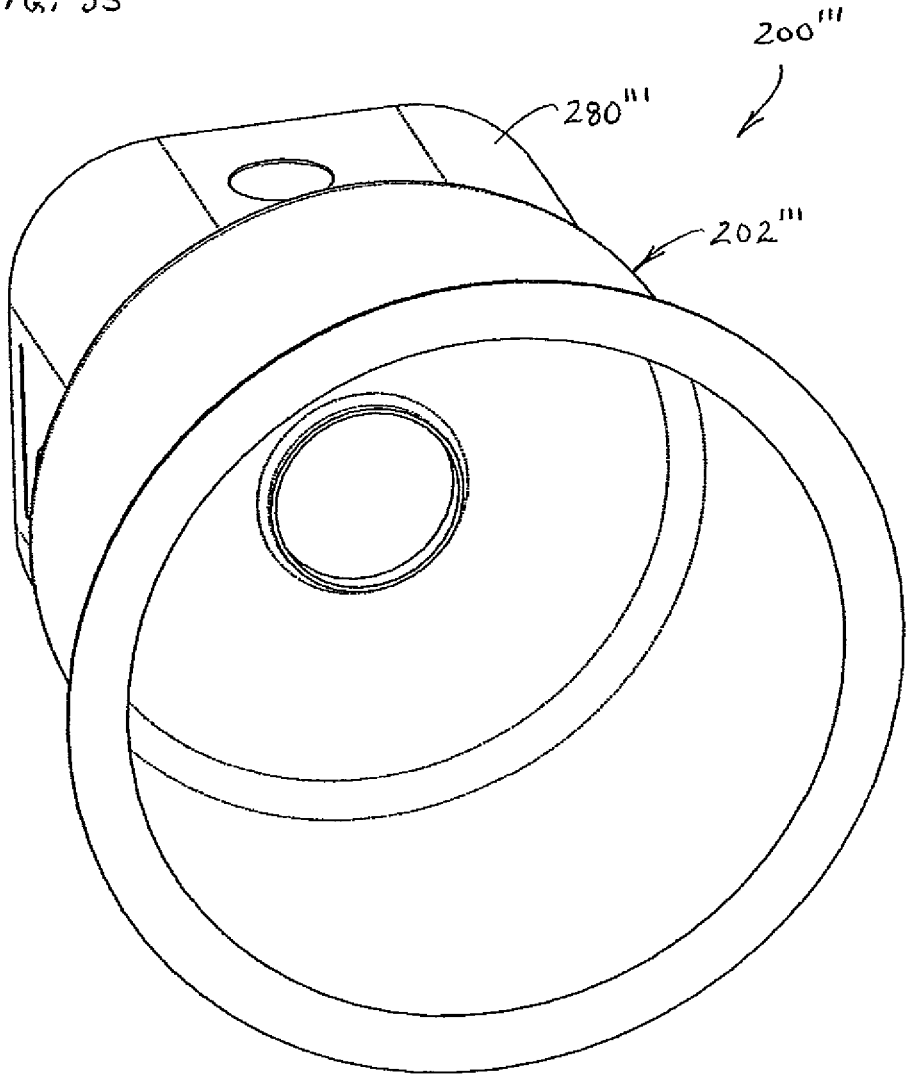
FIG. 35 is a bottom perspective view of an alternative example light fixture having the lamp housing and junction box integrally formed as a unit.
Figure 36:
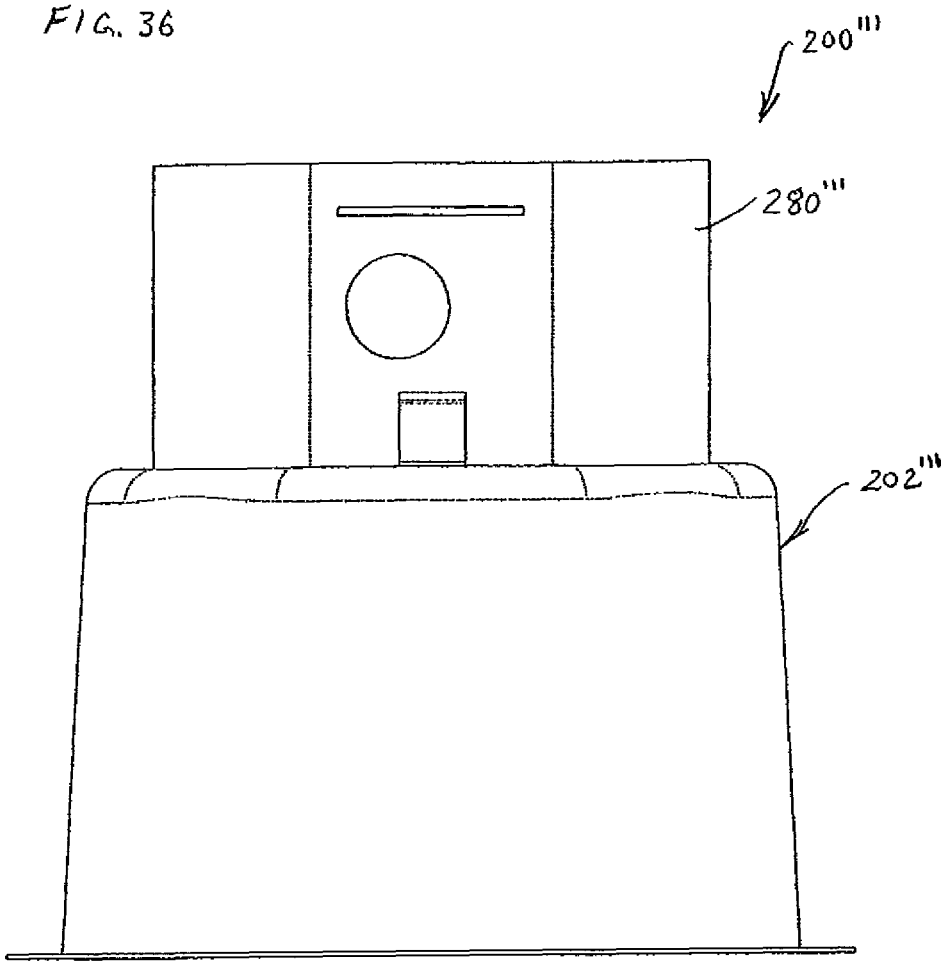
FIG. 36 is a side elevation view of the light fixture shown in FIG. 35.

FIGS. 35 and 36 illustrate a further example lamp housing 202'" with an integral junction box 280'" that are formed together in plastic as a single unit, such as by molding, to arrive at a light fixture 200'" that is comparable in all other respects to that of the light fixture 200' described above with reference to FIG. 20. This construction may offer simplified manufacturing and assembly in a non-conductive material.

Figure 37:
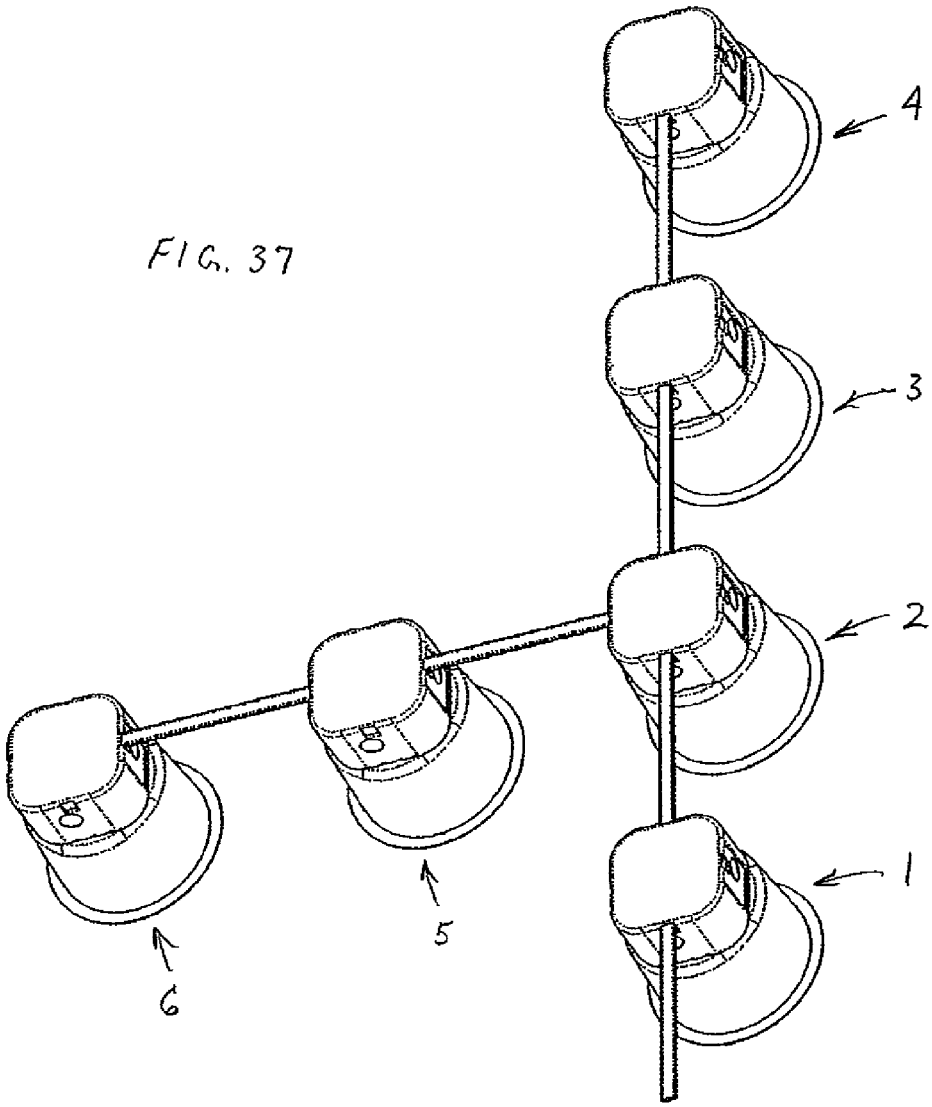
FIG. 37 is a top perspective view of a lighting system including a plurality of the light fixtures shown in FIG. 10.

A lighting system can be formed with a plurality of light fixtures that each include a socket assembly adapted to receive a lamp base and multiple terminal assemblies, where each terminal assembly has two or more metal components and the terminal assemblies of one of the plurality of light fixtures are adapted for connection to the terminal assemblies of another one of the plurality of light fixtures. This is illustrated in the example lighting system 500 shown in FIG. 37. The lighting system 500 includes a plurality of light fixtures 100 having socket assemblies 10, which are not shown in this figure but which were previously described with respect to FIGS. 1-7. In this example, a plurality of light fixtures 100 is connected to one another by daisy chaining, such as by use of wires (not shown) in conduit. Thus, the power source is supplied to the first fixture 1 and then fixture 2 is wired to fixture 1, and fixtures 3 and 5 are wired to fixture 2, with fixture 4 further wired to fixture 3, and fixture 6 further wired to fixture 5. In this manner, a lighting system 500 may be installed within a ceiling with minimal complexity and without requiring use of remote junction boxes for each light fixture.

Figure 38:
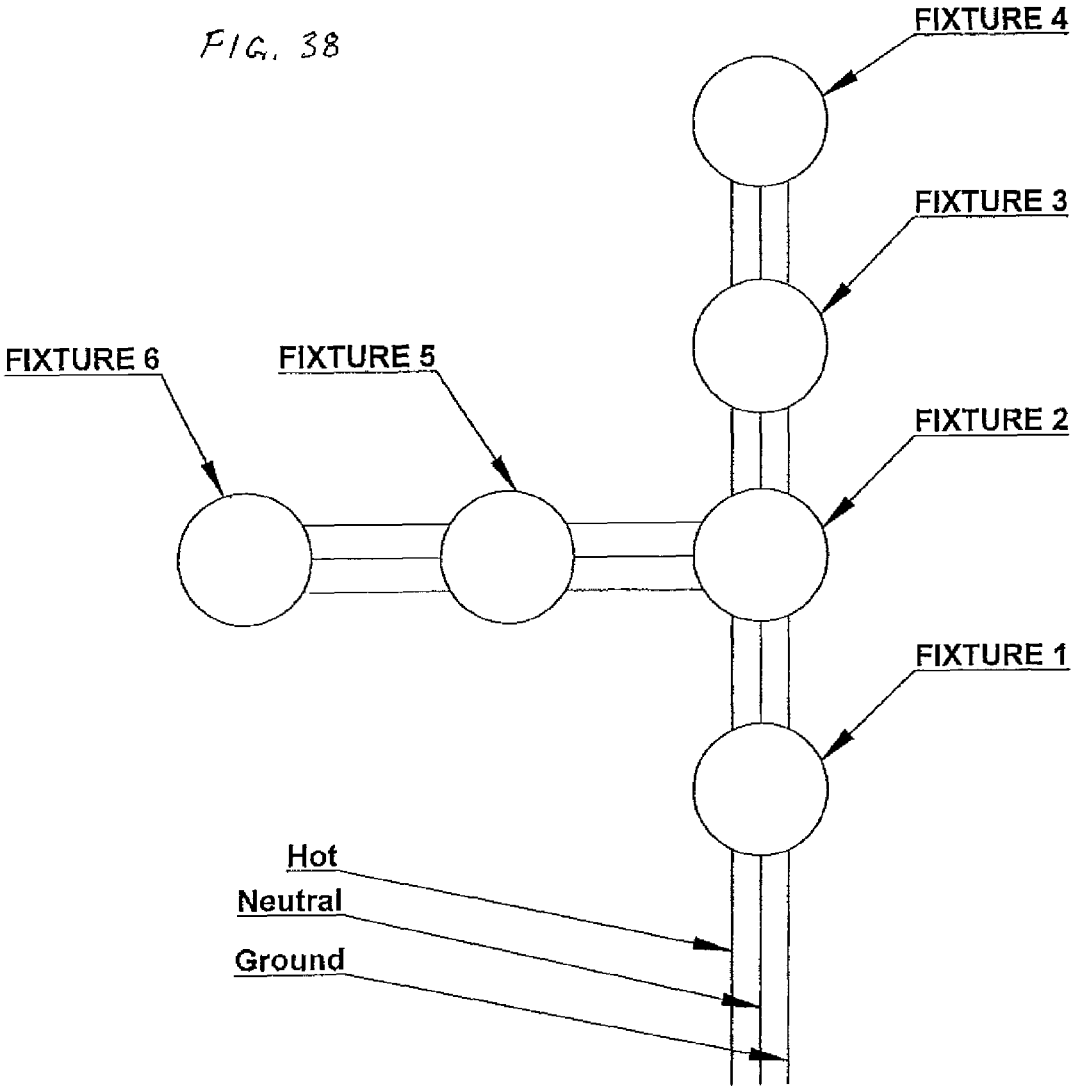
FIG. 38 is a schematic for the lighting system shown in FIG. 37, and including a Ground circuit of the type provided in the light fixture shown in FIG. 21.

FIG. 38 illustrates a schematic for the lighting system 500, but also includes provision for use of a Hot wire, Neutral wire and Ground wire, as discussed with respect to the example shown in FIG. 21. The light fixtures shown schematically in FIG. 38 represent any of the preceding example light fixtures and socket assemblies.

Using the socket assemblies and electrical apparatus described herein, such as for example, in light fixtures, it will be appreciated that a plurality of electrical apparatus may be combined into a system in many denominations and configurations, as desired. Further, this disclosure is not intended to be limiting with respect to the particular choice of materials, dimensions or other aspects of the structures and components referred to herein. It will be appreciated that any variety of suitable materials of construction, configurations, shapes and sizes for the components and methods of connecting the components may be utilized to meet the particular needs and requirements of an end user. Thus, various modifications can be made in the design and construction of such socket assemblies, electrical apparatus and systems without departing from the scope of the attached claims, and that the claims are not limited to the preferred embodiments illustrated.

We claim:

1. An integrated light fixture including a lamp housing and junction box that are formed as a one piece unit constructed from thermoplastic material and further comprising a socket assembly having terminal assemblies.

2. The integrated light fixture of claim 1 wherein the terminal assemblies are adapted to receive push-in terminations.

3. The integrated light fixture of claim 1 wherein the terminal assemblies are configured for engagement with wires having plug in terminations.

4. The integrated light fixture of claim 1 wherein the terminal assemblies are adapted to receive zero insertion force terminations.

5. The integrated light fixture of claim 1 further comprising a ballast or driver mounted on the lamp housing.

6. The integrated light fixture of claim 1 wherein the junction box and lamp housing share a common opening.

7. The integrated light fixture of claim 1 wherein the junction box includes an opening configured to receive a cover.

8. An integrated light fixture including a lamp housing and junction box that are formed as a one piece unit, wherein the lamp housing is constructed of a material that is substantially non-conductive.

9. The integrated light fixture of claim 8 further comprising a socket assembly having terminal assemblies.

10. The integrated light fixture of claim 9 wherein the lamp housing and junction box are constructed from thermoplastic material.

11. The integrated light fixture of claim 9 wherein the terminal assemblies are adapted to receive push-in terminations.

12. The integrated light fixture of claim 9 wherein the terminal assemblies are configured for engagement with wires having plug in terminations.

13. The integrated light fixture of claim 9 wherein the terminal assemblies are adapted to receive zero insertion force terminations.

14. The integrated light fixture of claim 8 further comprising a ballast or driver mounted on the lamp housing.

15. The integrated light fixture of claim 8 wherein the junction box and lamp housing share a common opening.

16. The integrated light fixture of claim 8 wherein the junction box includes an opening configured to receive a cover.

* * * * *